US007024150B2

(12) United States Patent
Fukuta et al.

(10) Patent No.: US 7,024,150 B2
(45) Date of Patent: Apr. 4, 2006

(54) SEPARABLE CLEANING DEVICE FOR AN IMAGE FORMING APPARATUS

(75) Inventors: Kazushi Fukuta, Kariya (JP); Takeshi Takami, Nagoya (JP); Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/663,823

(22) Filed: Sep. 17, 2003

(65) Prior Publication Data

US 2004/0052557 A1 Mar. 18, 2004

(30) Foreign Application Priority Data

Sep. 17, 2002 (JP) ..... 2002-269894
Sep. 27, 2002 (JP) ..... 2002-284284

(51) Int. Cl.
*G03G 21/00* (2006.01)

(52) U.S. Cl. ..... 399/345; 399/98

(58) Field of Classification Search ..... 399/98, 399/101, 149, 150, 343, 345, 113, 123, 120
See application file for complete search history.

(56) References Cited

U.S. PATENT DOCUMENTS 4,791,455 A * 12/1988 Yamamoto et al. ..... 399/345
4,876,572 A * 10/1989 Nagatsuna ..... 399/123 X
5,069,128 A * 12/1991 Hara et al. ..... 399/343 X
5,083,169 A * 1/1992 Usui et al. ..... 399/345 X
5,258,816 A * 11/1993 Haneda et al. ..... 399/345 X
5,697,017 A 12/1997 Rooke et al.
5,732,310 A * 3/1998 Hiroshima et al. ..... 399/101
5,784,962 A * 7/1998 Geis et al. ..... 399/345 X
5,911,101 A * 6/1999 Park ..... 399/345
5,970,281 A * 10/1999 Park ..... 399/101
6,219,505 B1 * 4/2001 Sato et al. ..... 399/98
6,459,869 B1 * 10/2002 Nittani et al. ..... 399/113 X
6,661,983 B1 * 12/2003 Yamaguchi ..... 399/101

FOREIGN PATENT DOCUMENTS

| | | |
|---|---|---|
| EP | 0 684 532 A1 | 11/1995 |
| JP | A 59-049575 | 3/1984 |
| JP | A 60-225185 | 11/1985 |
| JP | A 61-121076 | 6/1986 |
| JP | A 62-40483 | 2/1987 |
| JP | U 62-68162 | 4/1987 |
| JP | A 01-198783 | 8/1989 |
| JP | A 4-276766 | 10/1992 |
| JP | A 05-181295 | 7/1993 |
| JP | A 05-224518 | 9/1993 |
| JP | A 6-211374 | 8/1994 |
| JP | A 07-064456 | 3/1995 |

(Continued)

*Primary Examiner*—Sandra L. Brase
(74) *Attorney, Agent, or Firm*—Oliff & Berridge, PLC

(57) ABSTRACT

A contaminant removing member for removing contaminants adhering to the surface of the photoconductive member is contacted to and pressed against the surface of the photoconductive member by an engaging and disengaging mechanism only when a contaminant removing operation is performed. Accordingly, the contaminants adhering to the surface of the photosensitive drum can be removed while damage to the surface of the photosensitive drum is minimized. Alternatively the contaminant removing operation can be performed by a contaminant removing member removably mounted to one of a toner container or a photosensitive member container.

27 Claims, 22 Drawing Sheets

FOREIGN PATENT DOCUMENTS

| | | |
|---|---|---|
| JP | A 08-123283 | 5/1996 |
| JP | A 08-262955 | 10/1996 |
| JP | 09-244430 | 9/1997 |
| JP | A 09-258638 | 10/1997 |
| JP | A 10/221925 | 8/1998 |
| JP | A 2001-13838 | 1/2001 |
| JP | A 2001-282068 | 10/2001 |
| JP | 2002-1628874 | 6/2002 |

* cited by examiner

SEPARABLE CLEANING DEVICE FOR AN IMAGE FORMING APPARATUS

BACKGROUND OF THE INVENTION

1. Field of Invention

The invention relates to an electrophotographic image forming apparatus and a processing device used in the electrophotographic image forming apparatus.

2. Description of Related Art

An image forming apparatus, such as a laser-beam printer, is detachably attached with a processing device, which includes a photosensitive drum onto which an electrostatic latent image is formed, a developing roller for holding toner particles to be adhered onto the electrostatic latent image formed on the photosensitive drum, and a transfer roller for transferring a toner image, which is formed by adhering the toner particles to the latent image, onto a sheet.

In the processing device, toner particles held by the developing roller adhere to an electrostatic latent image formed on a surface of the photosensitive drum, thereby forming a toner image on the surface of the photosensitive drum. The toner image formed on the surface of the photosensitive drum is then transferred onto a sheet passing between the photosensitive drum and the transfer roller. Thus, an image is formed on the sheet.

When the toner particles adhere to a sheet, contaminants or foreign substances may adhere to the surface of the photosensitive drum from the sheet. Japanese Laid-Open Patent Publication No. 61-121076 discloses a device provided with a cleaning blade which is in contact with a surface of a photosensitive body at all times in order to physically remove contaminants adhering to the photosensitive body.

Because the cleaning blade is in contact with the surface of the photosensitive body at all times, the surface of the photosensitive body may be damaged or scratched if the contacting force of the cleaning blade against the surface of the photosensitive body is too strong. However, if the contacting force is too weak, the contaminants cannot be adequately removed from the surface of the photosensitive body, resulting in degradation of an image quality.

SUMMARY OF THE INVENTION

The invention addresses the above problems, and provides a more efficient cleaning system, by providing a contamination removing member that is capable of being placed into contact with a photosensitive element and withdrawn from that contact. When in contact with the photosensitive element, the contamination main moving member removes contaminants such as paper dust or residual toner from the photosensitive element. When withdrawn from the photosensitive element, there being no contact with that element, damage caused by the removing member can be minimized or damage to the photosensitive element by the contaminant removing member is minimized. Thus, the life of the photosensitive element is increased.

The removal operation is conducted at specified events. Among the events that may be used, either alone or in combination, are at the time a toner cartridge is indicated as empty, a time when an empty toner cartridge is replaced, after a predetermined number of sheets have been printed, during a warm-up session of the printer, or after the printing apparatus has been warmed up but prior to commencing printing.

In most embodiments, the contaminant removing member is an integral part of the printing apparatus. In those embodiments, it also includes an engagement and disengagement moving mechanism that brings the contaminant removing member into contact with the photosensitive element and withdraws the contaminant removing member therefrom. In some embodiments, the contaminant removing member may be a removable element that is manually attached to one of a photosensitive element cartridge or a developer containing cartridge. In these latter type cartridges, the most common time for use of the contaminant removing member is when the developer containing cartridge is changed.

BRIEF DESCRIPTION OF THE DRAWINGS

Embodiments of the invention will be described in detail with reference to the following figures wherein.

DETAILED DESCRIPTION OF PREFERRED EMBODIMENTS

Although described in the context of a laser-beam printer, the invention is applicable to any device, such as a facsimile machine or copier using a laser-beam printing device.

Figure 1:
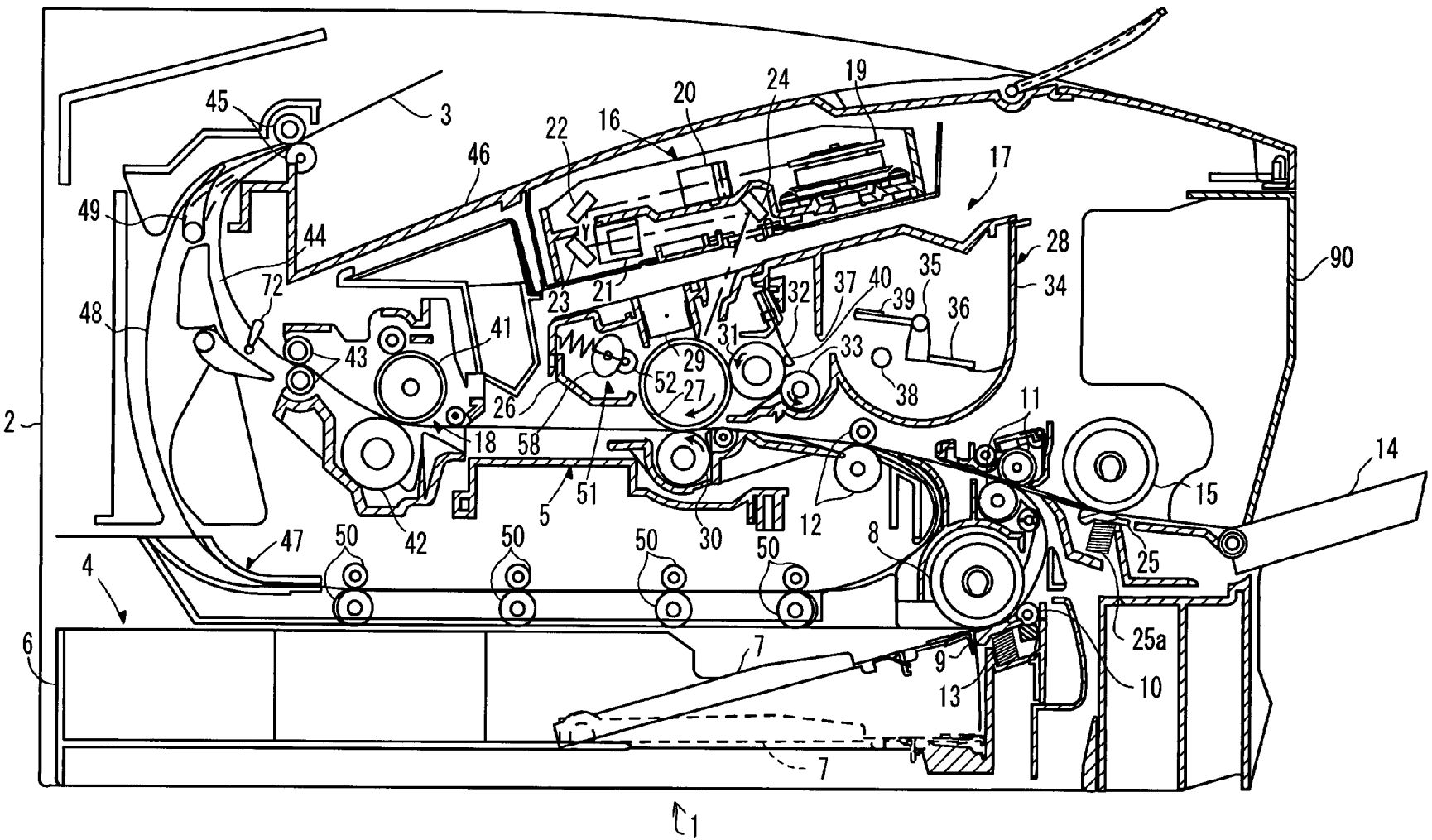
FIG. 1 is a sectional side view showing essential parts of a laser-beam printer of a first embodiment of the invention.

As shown in FIG. 1, a laser-beam printer 1 includes a feeder unit 4 for feeding sheets 3, as recording media, one by one, and an image forming unit 5 for forming an image onto the fed sheet 3 from the feeder unit 4, in its casing 2.

The right and left sides of FIG. 1 are defined as front and rear of the laser-beam printer 1, respectively.

The feeder unit 4 includes a sheet tray 6 detachably attached to a bottom of the casing 2, a sheet pressing plate 7 provided in the sheet tray 6, a sheet feed roller 8 and a sheet feed pad 9 disposed at a position above an end of the sheet tray 6, paper dust removing rollers 10, 11 disposed downstream of the sheet feed roller 8 in a sheet conveying direction, and a pair of resist rollers 12 provided downstream of the paper dust removing rollers 10, 11 in the sheet conveying direction.

The sheet pressing plate 7 can hold a stack of sheets 3 thereon. The sheet pressing plate 7 is swingably supported at its end, which is positioned at a distance from the sheet feed roller 8, so that the other end, which is positioned near the sheet feed roller 8, can swing up and down. The sheet pressing plate 7 is upwardly urged by a spring (not shown) from its underside. With this structure, the sheet pressing plate 7 swings downward against an urging force from the spring about the end, which is provided at a distance from the sheet feed roller 8, with an increase in an amount of sheets 3 thereon.

The sheet feed roller 8 and the sheet feed pad 9 are provided so as to be opposite to each other. The sheet feed pad 9 is pressed against the sheet feed roller 8 by a spring 13 provided under the sheet feed pad 9. A topmost sheet 3, in the stack on the sheet pressing plate 7, is pressed against the sheet feed roller 8 by the spring provided under the sheet pressing plate 7. As the sheet feed roller 8 rotates, the topmost sheet 3 is pinched between the sheet feed roller 8 and the sheet feed pad 9 by the rotation of the sheet feed roller 8, thereby feeding the topmost sheet 3. As described above, the sheets 3 in the stack are fed one by one from the feeder unit 4. Then, paper dust adhering to the fed sheet 3 is removed by the paper dust removing rollers 10, 11, and the sheet 3 is further conveyed to the resist rollers 12.

The pair of resist rollers 12 correct a deviation of the fed sheet 3 and further convey the sheet 3 to an image forming position, which is an image transfer position in which a toner image formed on the surface of the photosensitive drum 27 is transferred onto the sheet 3, namely, a contacting position where the photosensitive drum 27 and the transfer roller 30 contact with each other.

The feeder unit 4 further includes a multi-purpose tray 14, a multi-purpose sheet feed roller 15 and a multi-purpose sheet feed pad 25 for feeding sheets 3 stacked on the multi-purpose tray 14. The multi-purpose sheet feed roller 15 and the multi-purpose sheet feed pad 25 are disposed so as to be opposite to each other. The multi-purpose sheet feed pad 25 is pressed against the multi-purpose sheet feed roller 15 by a spring 25*a* provided under the multi-purpose sheet feed pad 25. As the multi-purpose sheet feed roller 15 rotates, a topmost sheet 3 is pinched between the multi-purpose sheet feed roller 15 and the multi-purpose sheet feed pad 25 by the rotation of the multi-purpose sheet feed roller 15, thereby feeding the topmost sheet 3. As described above, the sheets 3 in the stack are fed one by one from the multi-purpose tray 14.

The image forming unit 5 includes a scanner unit 16, a processing unit 17 as a processing device, and a fixing unit 18.

The scanner unit 16 is provided in an upper portion of the casing 2 and includes a laser emitting portion (not shown), a rotatable polygon mirror 19, lenses 20, 21 and reflectors 22, 23, 24. A laser beam emitted from the laser emitting portion, according to image data, passes through or is reflected off the polygon mirror 19, the lens 20, the reflectors 22, 23, the lens 21, and the reflector 24, in this order, as indicated by a dot-dash line, and then finally irradiates the surface of the photosensitive drum 27.

Figure 2:
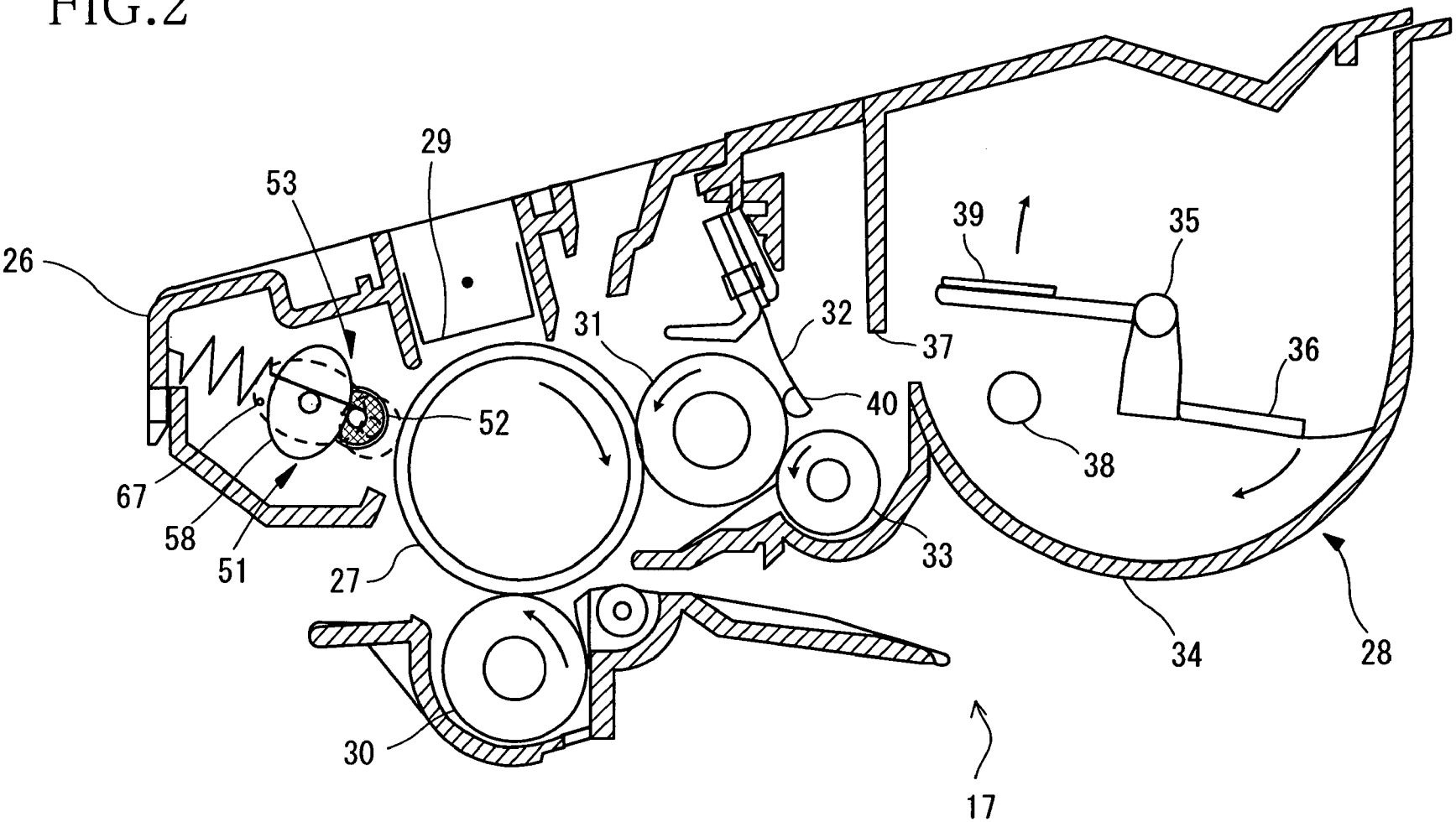
FIG. 2 is a sectional side view showing essential parts of a processing unit used for the laser-beam printer of FIG. 1.

The processing unit 17 is provided below the scanner unit 16 and includes a drum cartridge 26 detachably attachable to the casing 2. As shown in FIG. 2, the drum cartridge 26 includes a developing cartridge 28, the photosensitive drum 27 as a photosensitive body, a Scorotron charging device 29, the transfer roller 30 and a cleaning portion 51.

The developing cartridge 28 is detachably attached to the drum cartridge 26 and includes a developing roller 31 as a developing agent holding member, a layer-thickness regulating blade 32, a toner supply roller 33, and a toner hopper 34.

The toner hopper 34 accommodates positively electrically charged toner of a single non-magnetic component as a developing agent. The toner to be used is polymerized toner that is obtained by copolymerizing monomers, such as styrene-based monomers, for example, styrene, and polymerizable monomers, such as acrylic-based monomers, for example, acrylic acid, alkyl (C1–C4) acrylate, and alkyl (C1–C4) methacrylate, using a known polymerization method, such as a suspension polymerization. Polymerized toner particles are spherical in shape, having excellent fluidity, so that a high-quality image can be formed.

The toner is mixed with a coloring material, such as a carbon black, and wax, as well as silica as an external additive to improve the fluidity of the toner. A toner particle size is approximately 6 to 10 μm.

The toner is stored in the middle of the toner hopper 34. The toner hopper 34 includes a rotating shaft 35 to which a power is transmitted from a developing cartridge drive 79 (FIG. 5), and an agitator 36 supported by the rotating shaft 35. The toner accommodated in the toner hopper 34 is agitated by the agitator 36 and discharged from a toner supply opening 37 provided in the toner hopper 34. Windows 38 for confirming the amount of toner remaining in the toner hopper 34 are provided to both side walls of the toner hopper 34. The windows 38 are wiped and cleaned by a cleaner 39 supported by the rotating shaft 35.

Figure 5:
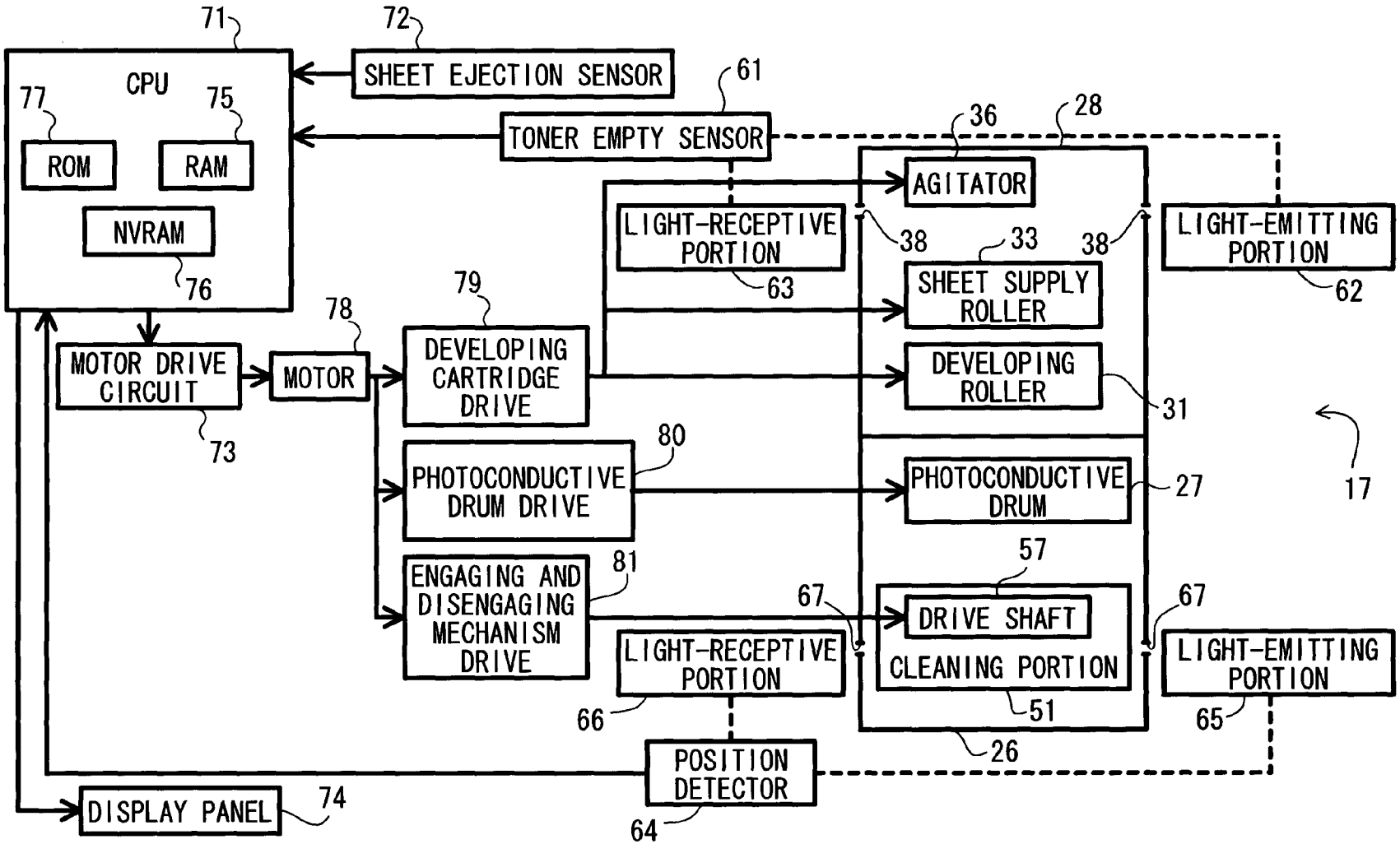
FIG. 5 is a block diagram for an engaging and disengaging operation of a cleaning roller with respect to the photosensitive drum.

As shown in FIG. 5, a light-emitting portion 62 and a light-receptive portion 63 of a toner-empty sensor 61, which is an optical sensor, are provided outside of the windows 38. In the toner-empty sensor 61, the light emitting portion 62 and the light-receptive portion 63 are disposed so as to be opposite to each other through the windows 38. The toner-empty sensor 61 detects a state of toner empty in the toner hopper 34 by the amount of light received by the light-receptive portion 63 with respect to the amount of light emitted from the light-emitting portion 62, and inputs a detection signal indicating the toner empty state to a CPU 71.

As shown in FIG. 2, the toner supply roller 33 is rotatably provided on the side of the toner supply opening 37. The developing roller 31 is rotatably provided so as to be opposite to the toner supply roller 33. The toner supply roller 33 and the developing roller 31 contact each other so as to apply some pressure to one another.

The toner supply roller 33 includes a metal roller shaft covered with a conductive foam material. The toner supply roller 33 rotates in a direction indicated by an arrow (in the counterclockwise direction) in FIG. 2 by the power transmitted from the developing cartridge drive 79 (FIG. 5).

The developing roller 31 includes a metal roller shaft covered with a conductive rubber material. More specifically, a portion of the developing roller 31, covered with a conductive rubber material, is formed of conductive urethane rubber or silicone rubber including fine carbon particles whose surface is coated with urethane rubber or silicone rubber including fluorine. A predetermined developing bias is applied to the developing roller 31. The developing roller 31 rotates in a direction indicated by an arrow as shown in FIG. 2 (in the counterclockwise direction) by the power transmitted from the developing cartridge drive 79 (FIG. 5).

The layer-thickness regulating blade 32 is provided adjacent to the developing roller 31. The layer-thickness regulating blade 32 includes a blade body made of a metal leaf spring and a pressing portion 40 attached to a free end of the blade body. The pressing portion 40 has a semicircular shape in cross section and is made of insulating silicone rubber. The layer-thickness regulating blade 32 is supported near the developing roller 31 by the developing cartridge 28 so that the pressing portion 40 presses the developing roller 31 with the elasticity of the blade body.

The toner discharged through the toner supply opening 37 is supplied to the developing roller 31 by the rotation of the toner supply roller 33. While passing between the toner supply roller 33 and the developing roller 31, the toner is positively charged by friction produced therebetween. As the developing roller 31 rotates, the toner held by the developing roller 31 enters between the developing roller 31 and the pressing portion 40 of the layer-thickness regulating blade 40 and it becomes a thin layer having uniform thickness on the developing roller 31.

The photosensitive drum 27 is rotatably supported next to the developing roller 31 by the drum cartridge 26 so as to face the developing roller 31. The photosensitive drum 27 includes a drum body made of an aluminum tube which is grounded. The surface of the drum body is coated by a positively-charged photosensitive layer made of polycarbonate. The photosensitive drum 27 rotates in a direction indicated by an arrow as shown in FIG. 2 (in the clockwise direction) by power transmitted from a photosensitive drum drive 80 (FIG. 5).

The Scorotron charging device 29 is provided above the photosensitive drum 27 so as to face the photosensitive drum 27 with a predetermined space provided therebetween. The Scorotron charging device 29 generates corona discharge from tungsten wires to positively charge the surface of the photosensitive drum 27.

The transfer roller 30 is disposed below the photosensitive drum 27 so as to be opposite to the photosensitive drum 27. The transfer roller 30 is supported in the drum cartridge 26 so as to be rotatable in the direction indicated by an arrow in FIG. 2 (in the counterclockwise direction). The transfer roller 30 includes a metal roller shaft covered with a conductive rubber material. A predetermined transfer bias is applied to the transfer roller 30 when the toner is transferred onto the sheet 3.

The surface of the photosensitive drum 27 is uniformly positively charged by the Scorotron charging device 29 and then exposed to a laser beam from the scanner unit 16, thereby forming an electrostatic latent image thereon. When the electrostatic latent image faces the developing roller 31, the positively-charged toner, held by the developing roller 31, is brought into contact with the photosensitive drum 27 and adheres to the electrostatic latent image, thereby forming a toner image on the photosensitive drum 27. The toner image formed onto the surface of the photosensitive drum 27 is then transferred onto the sheet 3 by the application of the transfer bias to the transfer roller 30 while the sheet 3 passes between the photosensitive drum 27 and the transfer roller 30.

In the laser-beam printer 1 of this embodiment, residual toner remaining on the surface of the photosensitive drum 27 is collected by the developing roller 31 after the toner image on the surface of the photosensitive drum 27 is transferred onto the sheet 3 by the transfer roller 30. With this structure, there is no need to provide a blade for wiping or removing the residual toner from the photosensitive drum 27 or a waste toner storage portion for storing the collected residual toner, thereby reducing the number of parts and downsizing the laser-beam printer 1.

Because the polymerized toner, having excellent fluidity and a sphere shape, is used in the laser-beam printer 1 of this embodiment, it is difficult to remove residual toner from the photosensitive drum 27 by using a blade. However, because the above-described residual toner collecting method is adopted in the laser-beam printer 1, the polymerized toner surely efficiently collected and removed from the photosensitive drum 27.

By contacting the photosensitive drum 27 with sheets 3, paper dust and additives contained in the sheets 3 adhere to the surface of the photosensitive drum 27. The sheets 3 contain additives, such as a filler, a paper durability promoter, and a sizing agent, as well as fibers.

The filler is a hard additive that makes the composition of paper dense and improves opacity, whiteness, and smoothness of the paper. Calcium carbonate, kaolin (china clay), or talc can be used as the filler. The paper durability promoter is an additive that makes the durability of the paper strong. The sizing agent is an additive that reduces absorption of liquid, such as ink, to prevent the ink from spreading on the paper. Alkyl ketene dimer or alkenyl succinic anhydride can be used as the sizing agent. Recycled paper, which is increasingly being used recently, contains high amounts of such additives.

As shown in FIG. 1, the fixing unit 18 is provided next to and downstream of the processing unit 17 and includes a heat roller 41, a pressing roller 42 that is pressed against the heat roller 41, and a pair of conveyor rollers 43 that are provided downstream of the heat roller 41 and the pressing roller 42 in the sheet conveying direction. The heat roller 41 includes a hollow tube made of aluminum coated by fluorine rubber and a halogen lamp is provided therein.

The toner transferred onto the fed sheet 3 in the processing unit 17 is melted by heat while the sheet 3 passes between the heat roller 41 and the pressing roller 42 and thus fixed on the sheet 3. Then, the sheet 3 is further conveyed to a sheet ejection passage 44 by the conveyor rollers 43. The sheet 3 fed to the sheet ejection passage 44 is further conveyed to a pair of sheet ejection rollers 45, and finally ejected onto a output tray 46 by the sheet ejection rollers 45. In the sheet ejection passage 44, a sheet ejection sensor 72 is provided near and downstream of the conveyor rollers 43 in the sheet conveying direction. The sheet ejection sensor 72 includes a swingable actuator that falls down and stands up in accordance with the contact and release of the sheet 3 with respect to the sheet ejection sensor 72. When a leading edge of a sheet 3 contacts and presses the sheet ejection sensor 72, the actuator falls down, and when a trailing edge of the sheet 3 releases from the sheet ejection sensor 72, the actuator stands up. The sheet ejection sensor 72 counts the number of sheets 3 which have passed by the sheet ejection sensor 72, by sheet by the falling and standing movement of the actuator, and inputs a count signal into the CPU 71 of FIG. 5.

The laser-beam printer 1 further includes a reverse conveyor portion 47 in order to form images on both surfaces of the sheet 3. The reverse conveyor portion 47 includes the pair of sheet ejection rollers 45, a reverse conveying passage 48, a flapper 49, and a plurality of reverse conveyor rollers 50.

The pair of sheet ejection rollers 45 are designed so that their rotating direction can be changed between normal and reverse directions. In order to eject the sheet 3 onto the output tray 46, the sheet ejection rollers 45 are rotated in the normal direction. In order to reverse the conveying direction of the sheet 3, the sheet ejection rollers 45 are rotated in the reverse direction.

The reverse conveying passage 48 extends in the up and down direction so that the sheet 3 can be conveyed from the sheet ejection rollers 45 to the plurality of reverse conveyor rollers 50 that are disposed below the image forming position. An upstream end of the reverse conveying passage 48 is provided near the sheet ejection rollers 45 and its downstream end is provided near the reverse conveyor rollers 50.

The flapper 49 is swingably provided at a point branching into the sheet ejection passage 44 and the reverse conveying passage 48. The position of the flapper 49 can be changed by energizing and deenergizing of a solenoid (not shown). By changing the position of the flapper 49, the conveying direction of the sheet 3 is changed between the direction to advance toward the sheet ejection passage 44 and the direction to advance toward the reverse conveying passage 48.

The plurality of the reverse conveyor rollers 50 are disposed in a substantially horizontal direction above the sheet tray 6. The most upstream pair of reverse conveyor rollers 50 are disposed near the downstream end of the reverse conveying passage 48, and the most downstream pair of reverse conveyor rollers 50 are disposed below the resist rollers 12.

The process for forming images on both surfaces of a sheet 3 will be described below. It is assumed that a sheet 3 has already had an image on one surface at this point. As the sheet 3 having the image on one surface reaches the sheet ejection rollers 45 through the sheet ejection passage 44 propelled by the conveyor rollers 43, the sheet ejection rollers 45 rotate in the normal direction pinching the sheet 3 therebetween and convey the sheet 3 toward the output tray 46 once.

When the trailing edge of the sheet 3 is pinched by the sheet ejection rollers 45 with the most part of the sheet 3 ejected to the outside, the sheet ejection rollers 45 stop rotating in the normal direction. Then, the position of the flapper 49 is changed by the excitation of the solenoid so that the sheet 3 is conveyed to the reverse conveying passage 48, and the sheet ejection rollers 45 rotate in the reverse direction. By the reverse rotation of the sheet ejection rollers 45, the sheet 3 is conveyed into the reverse conveying passage 48, and then is further conveyed to the resist rollers 12 by the plurality of reverse conveyor rollers 50. As the sheet 3 reaches the resist rollers 12, the sheet 3 is further conveyed toward the image forming point again in an upside down or reversed side orientation. Thus, the images are formed onto the both surfaces of the sheet 3.

The laser-beam printer 1 includes the cleaning portion 51 in the drum cartridge 26. As shown in FIG. 2, the cleaning portion 51 is disposed next to the photosensitive drum 27, facing the developing roller 31 while sandwiching the photosensitive drum 27 therebetween, and includes a cleaning roller 52 and an engaging and disengaging mechanism 53.

Figure 3A:
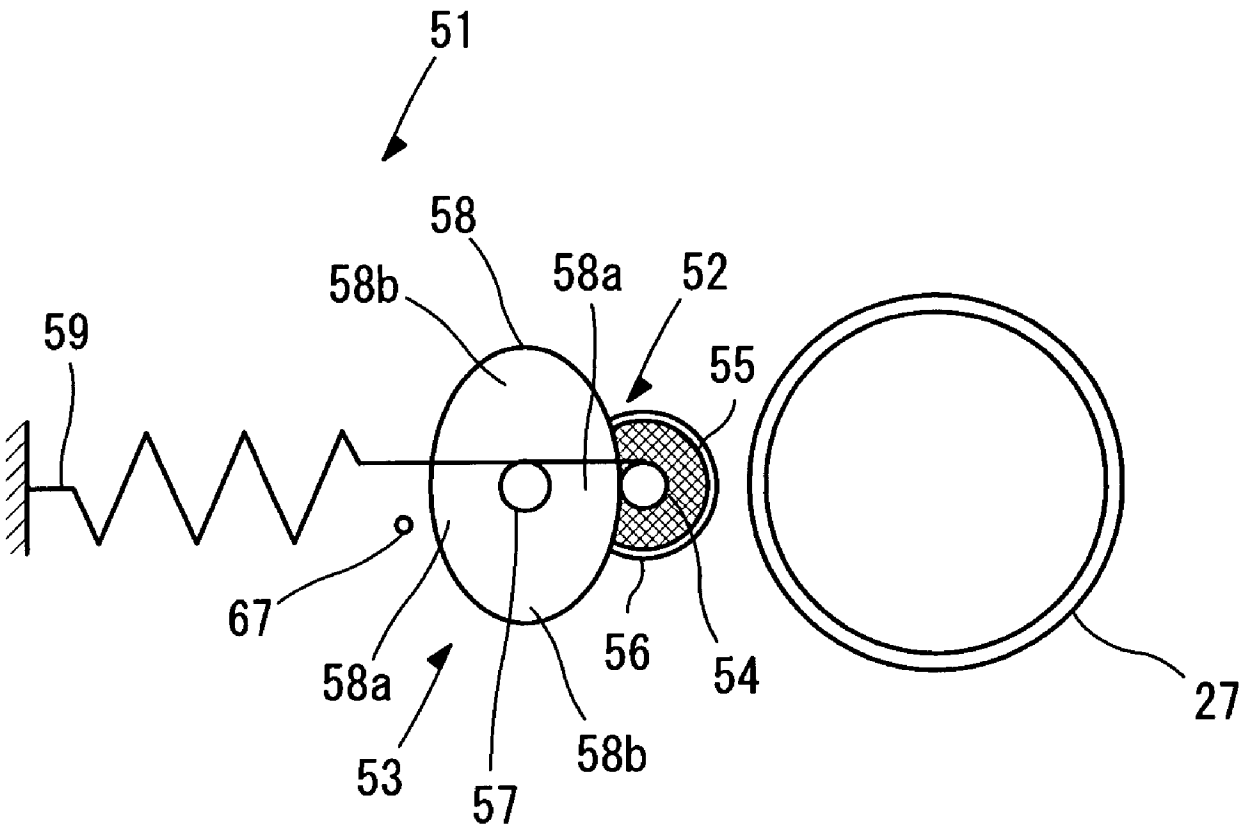
FIG. 3A is a side view showing a cleaning portion of the processing unit of FIG. 2 with the cleaning portion positioned at a distance from a photosensitive drum (disengaged state)

The cleaning roller 52 is disposed downstream of the transfer roller 30 and upstream of the Scorotron charging device 29 in the rotational direction of the photosensitive drum 27, while facing the photosensitive drum 27. As shown in FIG. 3A, the cleaning roller 52 includes a metal roller shaft 54 and a sponge member 55, as a support member, covering the roller shaft 54.

Figure 3B:
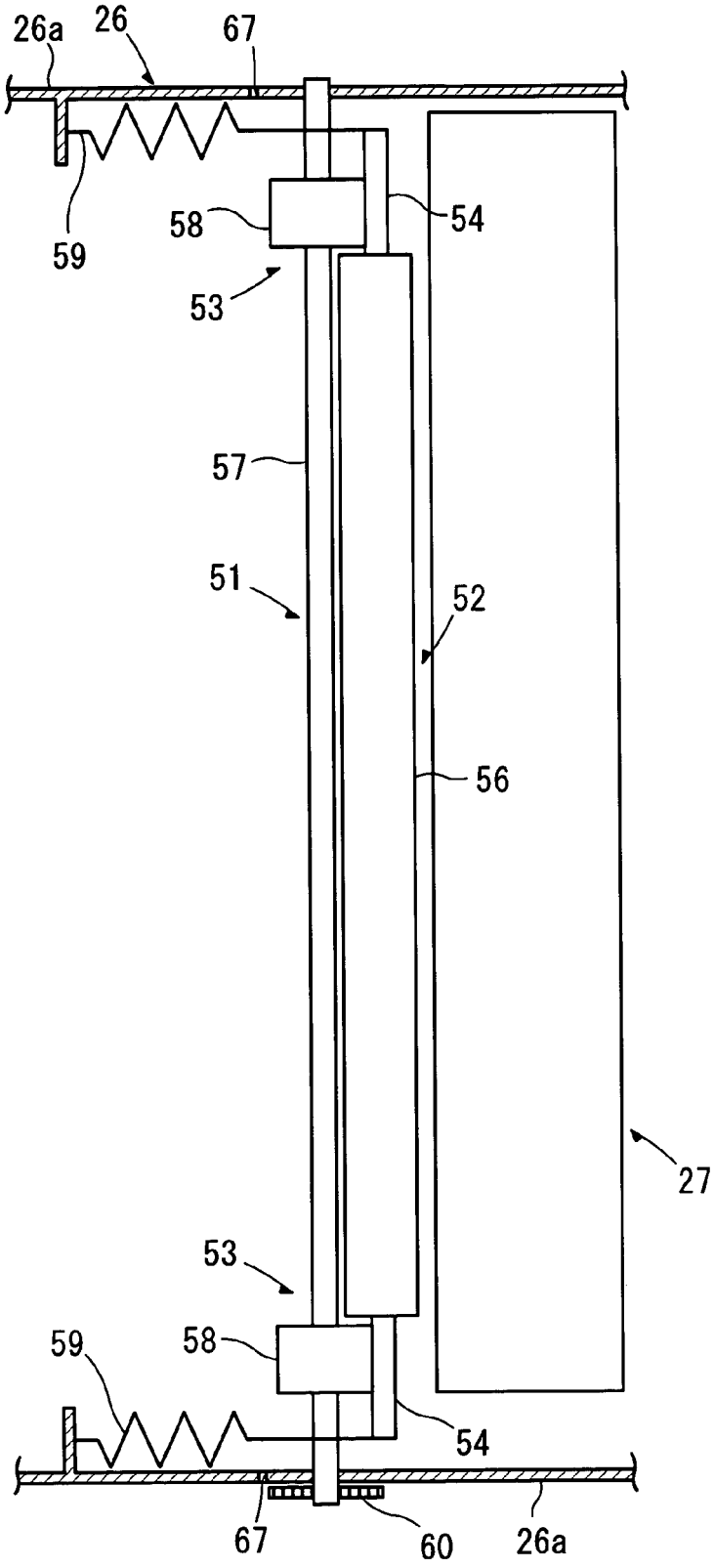
FIG. 3B is a plan view showing the cleaning portion of the processing unit of FIG. 2 with the cleaning portion positioned at a distance from a photosensitive drum (disengaged state)

As shown in FIG. 3B, the roller shaft 54 of the cleaning roller 52 extends in parallel with the axial direction of the photosensitive drum 27. The roller shaft 54 is supported by springs 59 of the engaging and disengaging mechanism 53 at its ends.

The sponge member 55, formed of an elastic body, such as urethane sponge, is provided around and along the roller shaft 54 so as to face an electrostatic latent image forming area of the photosensitive drum 27. A surface layer 56, which contacts the surface of the photosensitive drum 27, is provided on the surface of the sponge member 55.

The surface layer 56 is formed by paper. The paper may be non-recycled (virgin) paper or recycled paper. The paper is adhered to the surface of the sponge member 55 so as to cover the entire surface of the sponge member 55 along the axis direction of the roller shaft 54. Wrapping paper, felt, and nonwoven fabric can be also used as the surface layer 56. It is preferable that paper or nonwoven fabric is used as the surface layer 56 because paper and nonwoven fabric can efficiently remove contaminants adhering to the photosensitive drum 27.

The surface layer 56, which is made by laminating fiber materials and whose surface is uneven, is preferably used. The projections in the surface layer 56 wipe and remove contaminants or foreign matters from the surface of the photosensitive drum 27 by frictionally sliding over the surface of the photosensitive drum 27, and the gaps between the fibers catch and hold the contaminants therein. Because the surface layer 56 is formed by laminating the fiber materials to one another, a plurality of projections and gaps are provided at extremely small intervals. With this structure, the surface layer 56 can efficiently remove the contaminants from the surface of the photosensitive drum 27.

It is preferable that paper made by skimming fiber materials, such as cellulosic fiber, is used as the surface layer 56. The surface of such paper is uneven such that projections and gaps are developed like a mesh, so that the paper has high removability of contaminants. In addition, because the cellulosic fiber itself has an irregular structure, the removability of contaminants is further increased.

Furthermore, when paper, which is made from 100% virgin pulp with 15% or less by weight of a filler mixed therein, is used as the surface layer 56, additives adhering to the surface of the photosensitive drum 27 can be more effectively removed.

The surface layer 56 is firmly adhered to the surface of the sponge member 55, thereby surely removing contaminants from the surface of the photosensitive drum 27. In addition, the sponge member 55 is an elastic body, so that the surface layer 56 elastically contacts the surface of the photosensitive drum 27. Therefore, the surface layer 56 can efficiently remove the contaminants adhering to the surface of the photosensitive drum 27.

As shown in FIGS. 3A and 3B, the engaging and disengaging mechanism 53 includes a drive shaft 57, cams 58, and the springs 59. The drive shaft 57 is disposed so as to extend in parallel with the axial direction of the cleaning roller 52 on the side of the cleaning roller 52 opposite to the photosensitive drum 27 while sandwiching the cleaning roller 52 therebetween. The drive shaft 57 is rotatably supported by side walls 26*a* of the drum cartridge 26, at its ends. A drive gear 60, to which power is transmitted from an engaging and disengaging mechanism drive 81 (FIG. 5), is attached to one end of the drive shaft 57.

The thick-plate like cams 58 are provided to both the end portions of the drive shaft 57, respectively, so that the cams 58 face the roller shaft 54 protruding outward in the axial direction from both ends of the sponge member 55. The cams 58 are inserted onto the drive shaft 57 so as not to be rotatable relative to the drive shaft 57.

Each of the cams 58 has an oval shape in cross section and includes a thin portion 58*a* and a thick portion 58*b* which are integrated. By the rotation of the drive shaft 57, the thin portion 58*a* and the thick portion 58*b* alternatively contact the roller shaft 54.

The cams 58 are provided to the drive shaft 57 in the same phase. When the thin portion 58*a* of one of the cams 58 contacts the roller shaft 54, the thin portion 58*a* of the other cam 58 also contacts the roller shaft 54. As a matter of course, when the thick portion 58*b* of one of the cams 58 contacts the roller shaft 54, the thick portion 58*b* of the other cam 58 also contacts the roller shaft 54.

The springs 59 are coil tension springs, which are provided so as to be opposite to the respective ends of the roller shaft 54. One end of each spring 59 is fixed to a respective side wall 26*a* and the other end is fixed to a respective end of the roller shaft 54. Therefore, the roller shaft 54 of the cleaning roller 52 is urged in a direction to contact the cams 58, by tensile force from the springs 59, at all times.

When the thin portions 58*a* of the cams 58 are brought into contact with the roller shaft 54 by the rotation of the drive gear 60, due to the transmission of the power to the drive gear 60 from the engaging and disengaging mechanism drive 81 (FIG. 5), as shown in FIGS. 3A and 3B, the cleaning roller 52 moves in a direction to separate from the surface of the photosensitive drum 27 and is kept at a distance from the photosensitive drum 27. This condition is referred to as a disengaged state.

Figure 4A:
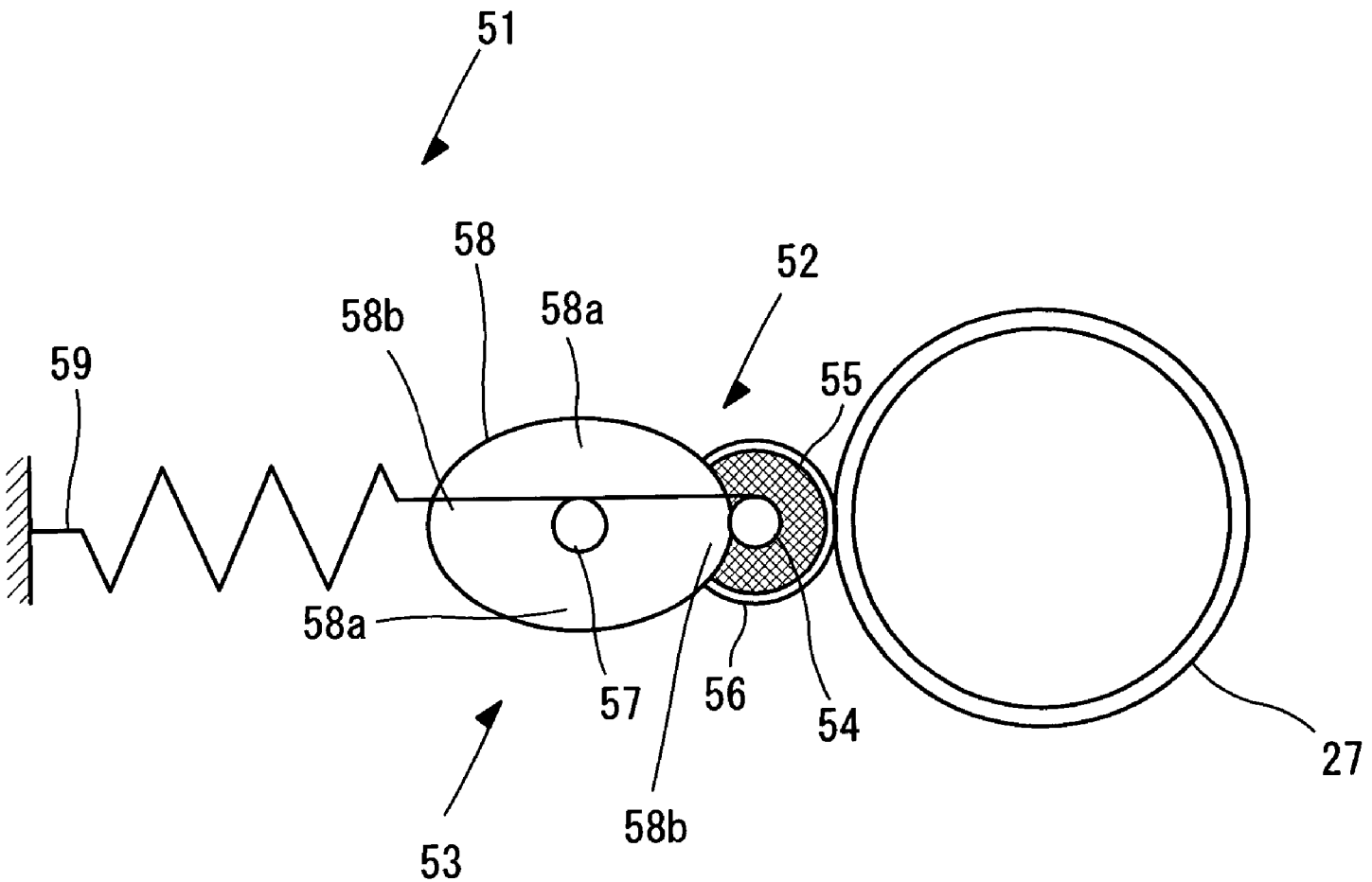
FIG. 4A is a side view showing the cleaning portion of the processing unit of FIG. 2 with the cleaning portion being in contact with the photosensitive drum (engaged state)
Figure 4B:
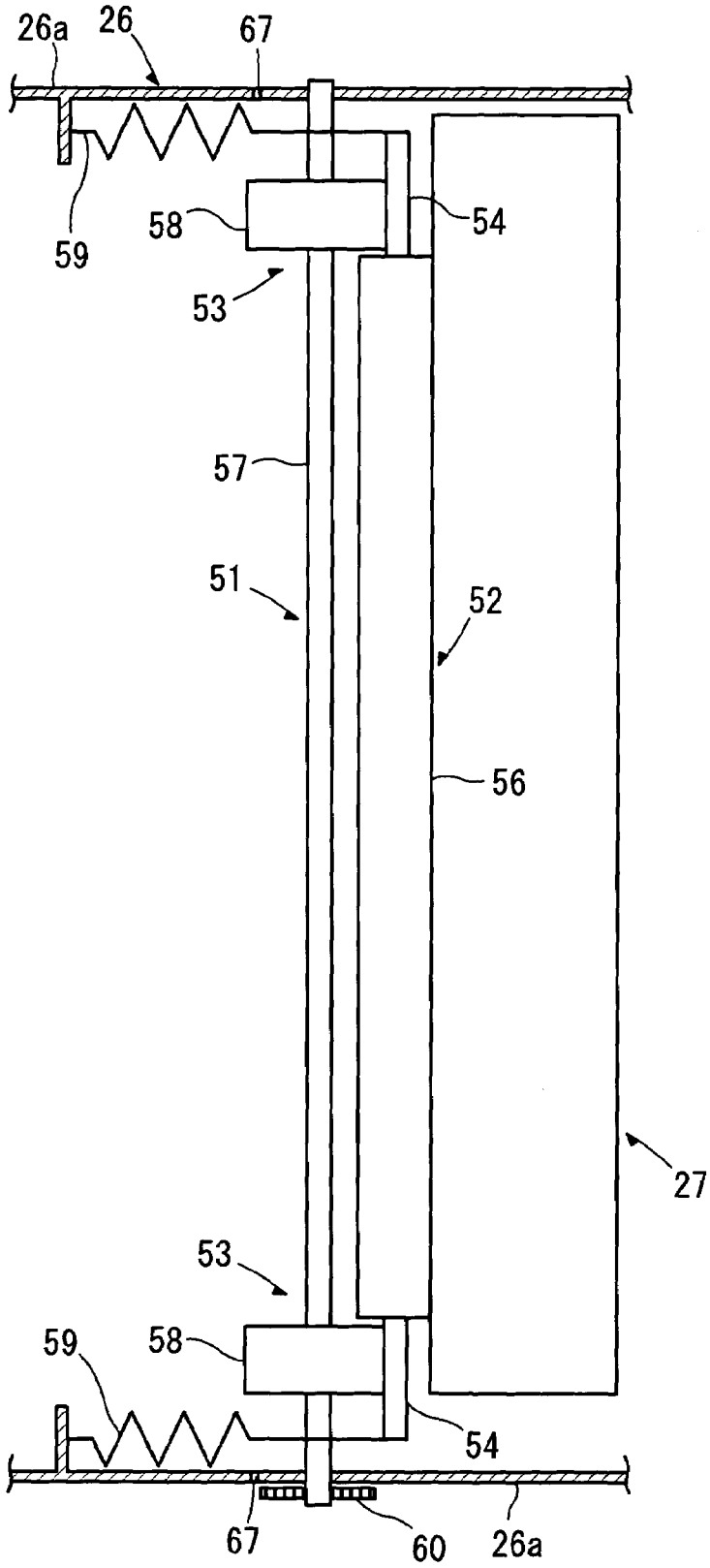
FIG.4B is a plan view showing the cleaning portion of the processing unit of FIG. 2 with the cleaning portion being in contact with the photosensitive drum (engaged state)

When the thick portions 58*b* of the cams 58 contact the roller shaft 54, by the rotation of the drive gear 60, as shown in FIGS. 4A and 4B, the cleaning roller 52 moves in a direction to contact the surface of the photosensitive drum 27 and thus engages and presses the surface of the photosensitive drum 27. This condition is referred to as an engaged state.

A window 67 is provided in the side walls 26*a* of the drum cartridge 26 so as to be opposite to each of the cams 58. As shown in FIG. 5, a light-emitting portion 65 and a light-receptive portion 66 of a position detector 64 are provided at the respective positions corresponding to the windows 67.

In the disengaged state where the thin portions 58*a* of the cams 58 contact the roller shaft 54, light emitted from the light-emitting portion 65 reaches the light-receptive portion 66 through the windows 67 and is detected by the position detector 64. In the engaged state where the thick portions 58*b* of the cams 58 contact the roller shaft 54, light emitted from the light-emitting portion 65 is blocked by the thick portions 58*b* of the cams 58 and thus cannot reach the light-receptive portion 66.

As described above, the position detector 64 can determine the phase of the cams 58 by detecting the light by the light-receptive portion 66. The CPU 71 also can determine whether the cleaning roller 52 is in contact with or out of contact with the photosensitive drum 27, in accordance with the detection of the light by the light-receptive portion 66.

When the light-receptive portion 66 detects the light, the CPU 71 determines that the cleaning roller 52 is in the disengaged state. When the light-receptive portion 66 does not detect the light, the CPU 71 determines that the cleaning roller 52 is in the engaged state. As described above, the CPU 71 controls the rotation of the drive shaft 57 in accordance with detection of the light by the light-receptive portion 66.

FIG. 5 is a block diagram of the hardware that controls the engaging and disengaging operation of the cleaning roller 52 with respect to the photosensitive drum 27. The time at which the cleaning roller 52 is brought into contact with the photosensitive drum 27 will be discussed with reference to FIG. 5. In the laser-beam printer 1, the sheet ejection sensor 72, the toner empty sensor 61, a motor drive circuit 73, the position detector 64 and a display panel 74 are connected to the CPU 71.

The CPU 71 includes a RAM 75, an NVRAM 76, and a ROM 77 and controls each unit. The RAM 75 stores provisional values inputted from the sheet ejection sensor 72, the toner empty sensor 61, and the position detector 64. The NVRAM 76 stores a page count value which is counted by the sheet ejection sensor 72. The value stored in the NVRAM 76 is not erased even when the power of the laser-beam printer is turned off. The ROM 77 stores a control program for controlling the motor drive circuit 73.

The motor drive circuit 73 is connected to a motor 78, to which the developing cartridge drive 79, the photosensitive drum drive 80 and the engaging and disengaging mechanism drive 81 are connected.

The developing cartridge drive 79 includes a well-known gear mechanism and a clutch mechanism and is connected with the rotating shaft 35 of the agitator 36, the toner supply roller 33 and the developing roller 31. The developing cartridge drive 79 transmits the power from the motor 78, which is driven under the motor drive circuit 73, to the rotating shaft 35 of the agitator 36, the toner supply roller 33 and the developing roller 31 to rotate the rotating shaft 35 of the agitator 36, the toner supply roller 33 and the developing roller 31 under the control of the CPU 71.

The photosensitive drum drive 80 includes a well-known gear mechanism and clutch mechanism and is connected with the photosensitive drum 27. The photosensitive drum drive 80 transmits the power from the motor 78, which is driven by the motor drive circuit 73, to the photosensitive drum 27 to rotate the photosensitive drum 27 under control of the CPU 71.

The engaging and disengaging mechanism drive 81 includes a well-known gear mechanism and clutch mechanism and is connected with the drive shaft 57 of the engaging and disengaging mechanism 53. The engaging and disengaging mechanism drive 81 transmits the power from the motor 78, which is driven by the motor drive circuit 73, to the drive gear 60 to rotate the drive shaft 57 under the control of the CPU 71.

Although not shown in FIG. 1, the display panel 74 is provided at the upper surface of the casing 2 and includes a LCD (liquid crystal display) portion to display various information about the laser-beam printer 1 to a user. For example, when a detection signal indicating toner empty is inputted into the CPU 71 from the toner empty sensor 61, the condition that the toner hopper 34 is empty of toner is provided to the user via the LCD portion. After the input of the detection signal is stopped by refilling the toner hopper 34 with toner, the notice is cancelled.

In this laser-beam printer 1, the CPU 71 controls the engaging and disengaging mechanism drive 81 so that the cleaning roller 52 is out of contact with the photosensitive drum 27 while the image forming operation is performed. On the other hand, the CPU 71 controls the engaging and disengaging mechanism 81 so that the cleaning roller 52 contacts and presses the photosensitive drum 27, at a predetermined timing, while the image forming operation is not performed, that is, the operation for forming an electrostatic latent image onto the photosensitive drum 27 is not performed, and after the portion, at which a transfer of a toner image onto a sheet 3 from the photosensitive drum 27 is completed, reaches the developing roller 31.

In the engaged state, when the CPU 71 controls the photosensitive drum drive 80 to rotate the photosensitive drum 27, the cleaning roller 52 removes contaminants or foreign matter adhering to the photosensitive drum 27. At the same time, fogging developed onto the surface of the photosensitive drum 27 is also removed.

More particularly, the CPU 71 generally stops the rotation of the drive shaft 57 at the position where a detection signal from the position detector 64 indicates the disengaged position, so that the cleaning roller 52 is positioned at a distance from the photosensitive drum 27. The CPU 71 rotates the drive shaft 57 until the detection signal from the position detector 64 indicates the engaged position so as to make the cleaning roller 52 contact and press the photosensitive drum 27.

Then, the CPU 71 controls the engaging and disengaging mechanism drive 81 so that the cleaning roller 52 is held at the position where the detection signal indicating the engaged state, for a predetermined period of time, for example, at least a time required for one revolution of the photosensitive drum 27. Then, the CPU 71 rotates the drive shaft 57 until the detection signal from the position detector 64 indicates the disengaged state so as to make the cleaning roller 52 disengage from the photosensitive drum 27.

The CPU 71 controls the photosensitive drum drive 80 to rotate the photosensitive drum 27 while holding and stopping the cleaning roller 52 with the cleaning roller 52 contacting and pressing the photosensitive drum 27.

The predetermined timing, that is, the times at which the cleaning roller 52 is brought into contact with the photosensitive drum 27 include the time at which the toner empty is notified or the notification of the toner empty is removed, the time at which a predetermined number of sheets has been printed, while the laser-beam printer 1 is warmed up, or the time at which the laser-beam printer 1 is turned on. The cleaning roller 52 may be contacted to the photosensitive drum 27 at any one of the timings or at a plurality of the timings described above. Other timings may also be selected but those identified are most common. The time at which the toner empty is notified is, more particularly, the time at which the toner empty is informed via the LCD portion of the display panel 74. The time at which the notification of the toner empty is removed is, more particularly, the time at which the notification of the toner empty shown via the LCD portion of the display panel 74 is removed. The time at which the predetermined number of sheets has been printed is, more particularly, the time at which a count value representing the number of printed sheets stored in the NVRAM 76 reaches a predetermined set value, which is generally set to a range of, for example, 1000 sheets to 5000 sheets. The number of printed sheets is counted by the sheet ejection sensor 72. The photosensitive drum 27 generally has a lifespan of up to 20000 copies, so that the cleaning of the photosensitive drum 27 is performed 4 to 20 times until the termination of its useful life after first use. The warm-up time of the laser-beam printer 1 is the time during a preparation at which the photosensitive drum 27 is rotated at idle before the printing operation is performed. When a cover 90 (FIG. 1) is closed after being open, the laser-beam printer 1 is automatically brought into the preparation state by the CPU 71. The time at which the laser-beam printer 1 is turned on is, more particularly, the time at which the main power of the laser-beam printer 1 is turned on and activated.

When the cleaning roller 52 is contacted to the photosensitive drum 27 at the above-described timings, the cleaning roller 52 can be contacted to the photosensitive drum 27 at the optimum timing. Accordingly, contaminants adhering to the photosensitive drum 27 can be efficiently removed.

The time at which the cleaning roller 52 makes contact with the photosensitive drum 27 is determined depending on the materials forming the surface layer 56 of the cleaning roller 52 and the environment where the laser-beam printer 1 is installed. In the laser-beam printer 1 of the first embodiment, as described above, the cleaning roller 52 is contacted to the photosensitive drum 27 at the predetermined timing or timings while the printing operation is not performed, by controlling the rotation of the drive shaft 57 of the engaging and disengaging mechanism 53 by the CPU 71. That is, it is unnecessary to contact the cleaning roller 52 to the photosensitive drum 27 at all times, and the cleaning roller 52 can be contacted to the photosensitive drum 27 only at the necessary timing.

Further, the cleaning roller 52 contacts and presses the photosensitive drum 27 with a strong contacting force for a short-time. Accordingly, the extent of damage to the photosensitive drum 27 can be reduced and contaminants adhering to the photosensitive drum 27 can be efficiently removed by the strong contacting force from the cleaning roller 52. Thus, an image can be formed with high resolution and high quality.

Because the CPU 71 controls the cleaning roller 52 so the cleaning roller 52 contacts the photosensitive drum 27 at the predetermined timing while the formation of an electrostatic latent image onto the photosensitive drum 27 is not performed, a load is not applied to the photosensitive drum 27 while an electrostatic latent image is formed on the photosensitive drum 27. Thus, the electrostatic latent image can be normally formed on the photosensitive drum 27.

Further, the CPU 71 controls the engaging and disengaging mechanism 53 so that cleaning roller 52 contacts the photosensitive drum 27 at the predetermined timing other than the time while a portion of the photosensitive drum 27, that had a toner image is in contact with developing roller 31, that is, at the predetermined timing after a position, at which the transfer of the toner on the photosensitive drum 27 to the sheet 3 is completed, reaches the developing roller 31.

That is, until residual toner remaining on the surface of the photosensitive drum 27 is collected and removed by the developing roller 31 after transfer of the image is completed, the cleaning roller 52 is not brought into contact with the photosensitive drum 27. Therefore, the residual toner does not adhere to the cleaning roller 52, so that degradation of the cleaning capability of the cleaning roller 52 is prevented. Thus, the cleaning roller 52 can sufficiently remove contaminants adhering to the surface of the photosensitive drum 27 for the long term. Accordingly, the laser-beam printer 1, to which the processing unit 17 including the engaging and disengaging mechanism 53 is attached, can form an image with high resolution and high quality.

The processing unit 17 does not itself include a motor. When the processing unit 17 is attached to the casing 2, the drive shaft 57 of the drive gear 60 is connected to the engaging and disengaging mechanism drive 8 1, whereby power from the motor 78 provided in the casing 2 is transmitted to the drive shaft 57 via the drive gear 60. As described above, when the motor 57 is driven, the drive shaft 57 rotates to engage or disengage the cleaning roller 52 to or from the photosensitive drum 27.

As described above, in the laser-beam printer 1, because the power is transmitted to the drive shaft 57 by attaching the processing unit 17 to the casing 2 even though a motor is not provided in the processing unit 17, the laser-beam printer 1 can form an image with high resolution and high quality while a reduction in the size and weight of the processing unit 17 can be achieved.

The photosensitive drum 27 is rotated while the cleaning roller 52 is stopped and held with the cleaning roller 52 contacting the photosensitive drum 27. Therefore, only a specific portion of the cleaning roller 52 contacts the photosensitive drum 27 while the two elements are in contact with each other. With this structure, the cleaning capability of the specific portion of the cleaning roller 52 may be degraded because of large amounts of contaminants adhered to the photosensitive drum 27.

In order to avoid contacting the portion having poor cleaning capability to the photosensitive drum 27, the portion of the cleaning roller 52 to be contacted with the photosensitive drum 27 may be changed at a proper timing. FIGS. 6A–6F show an example of the above situation. In order to embody this control, it is necessary that the roller shaft 54 of the cleaning roller 52 be rotatably supported by springs at its ends, wherein one end of the roller shaft 54 protrudes to the outside from the side wall 26*a* of the drum cartridge 26 so as to have the drive gear 60 attached. The engaging and disengaging mechanism 81 is also connected with the roller shaft 54 so that the CPU 71 can control the rotation of the cleaning roller 52.

Figure 6A:
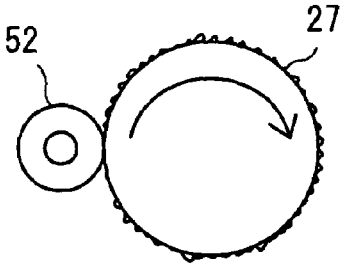
FIG. 6A is a diagram showing a process for controlling the cleaning roller so that a clean portion of the cleaning roller contacts the photosensitive drum every time, wherein the cleaning roller is in contact with the photosensitive drum to remove contaminants from the surface of the photosensitive drum.
Figure 6B:
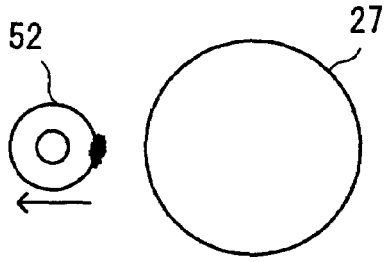
FIG. 6B is a diagram showing the process for controlling the cleaning roller so that a clean portion of the cleaning roller contacts the photosensitive drum every time, wherein the cleaning roller is disengaged from the photosensitive drum after the cleaning roller removes the contaminants from the photosensitive drum.
Figure 6C:
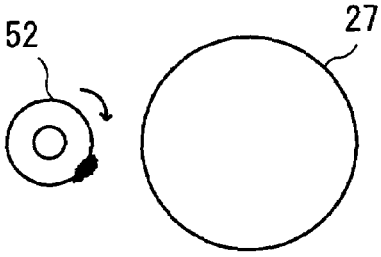
FIG. 6C is a diagram showing the process for controlling the cleaning roller so that a clean portion of the cleaning roller contacts the photosensitive drum every time, wherein the cleaning roller having the contaminants is rotated for a second contaminant removing operation.

First, as shown in FIG. 6A, the cleaning roller 52 is brought into contact with and is pressed against the photosensitive drum 27 to clean the surface of the photosensitive drum 27. Then, as shown in FIG. 6B, the cleaning roller 52 is disengaged from the photosensitive drum 27. Next, the cleaning roller 52 is rotated so that the portion that has previously contacted the photosensitive drum 27 during the cleaning operation does not contact the photosensitive drum 27 again, as shown in FIG. 6C.

Figure 6D:
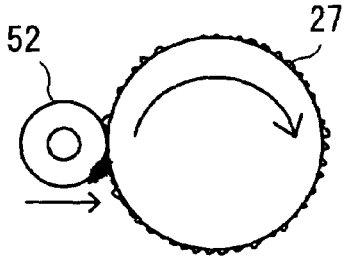
FIG. 6D is a diagram showing the process for controlling the cleaning roller so that a clean portion of the cleaning roller contacts the photosensitive drum every time, wherein the cleaning roller is in contact with the photosensitive drum to remove contaminants from the surface of the photosensitive drum at the second contaminant removing operation.

Then, as shown in FIG. 6D, the cleaning roller 52 is brought into contact with the photosensitive drum 27 with a different portion, than that portion previously contacting the photosensitive drum 27, contacting the photosensitive drum 27. By doing so, at this time, contaminants adhering to the photosensitive drum 27 can be excellently removed.

Figure 6E:
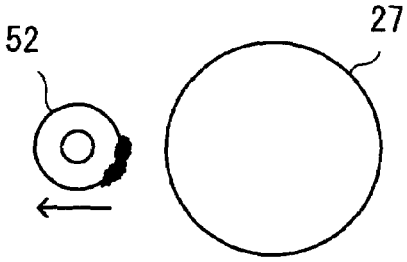
FIG. 6E is a diagram showing the process for controlling the cleaning roller so that a clean portion of the cleaning roller contacts the photosensitive drum every time, wherein the cleaning roller is disengaged from the photosensitive drum after the second contaminant removing operation.
Figure 6F:
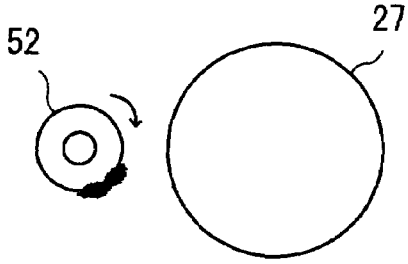
FIG. 6F is a diagram showing the process for controlling the cleaning roller so that a clean portion of the cleaning roller contacts the photosensitive drum every time, wherein the cleaning roller having the contaminants is rotated for a third contaminant removing operation.

After the cleaning roller 52 is released from the photosensitive drum 27, as shown in FIG. 6E, the cleaning roller 52 is again slightly rotated so that the portion, which contacted the photosensitive drum 27 during the second cleaning operation, does not contact the photosensitive drum 27 at a third cleaning operation. By doing so, at the third cleaning operation, the cleaning roller 52 contacts the photosensitive drum 27 with a portion, which is different from the previous contact portions at the first and second cleaning operations, contacting the photosensitive drum 27. Accordingly, contaminants adhering to the photosensitive drum 27 can be also efficiently removed at the third cleaning operation. By repeatedly performing the above control, contaminants adhering to the surface of the photosensitive drum 27 can be efficiently removed at all times when the cleaning roller 52 is in contact with the photosensitive drum 27.

It is unnecessary to rotate the cleaning roller 52 after every time the cleaning roller 52 is released from the photosensitive drum 27. It is essential only that the rotational timing of the cleaning roller 52 is determined according to the usage condition and installed environment of the laser-beam printer 1. Although, in the above-described embodiment, the cleaning roller 52 includes the sponge member 55, urethane rubber or silicone rubber may be used instead of sponge member 55.

Figure 7:
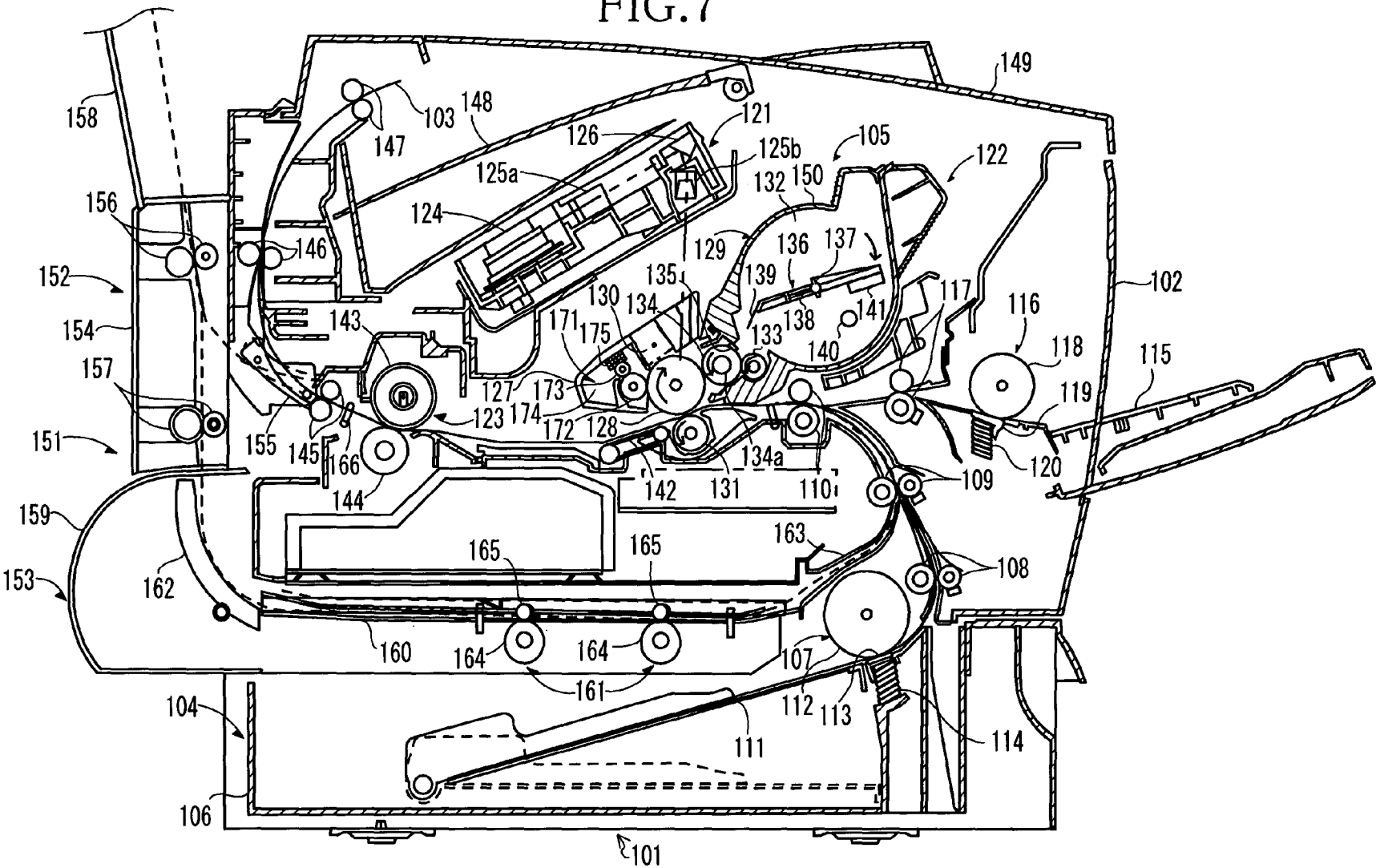
FIG. 7 is a sectional side view showing essential parts of a laser-beam printer of a second embodiment of the invention.

FIG. 7 is a side sectional view showing a laser-beam printer 101 of a second embodiment, as an image forming apparatus of the invention. In FIG. 7, a laser-beam printer 101 is an electrophotographic laser-beam printer that forms an image by using toner of a single non-magnetic component. The laser-beam printer 101 includes a feeder unit 104 that feeds sheets 103, as recording media, one by one, and an image forming unit 105 that forms an image onto the fed sheet 103, in casing 102.

The feeder unit 104 includes a sheet tray 106 detachably attached to a bottom part of the casing 102, a sheet feed mechanism 107 provided at a side end of the sheet tray 106, pairs of conveyor rollers 108, 109 disposed downstream of the sheet feed mechanism 107 in a conveying direction of the sheet 103, and a pair of resist rollers 110 disposed downstream of the conveyor rollers 108, 109 in the sheet conveying direction 103.

The sheet tray 106 has a box shape with an upper open structure so as to hold a stack of sheets 103 therein and is detachably attached to the bottom part of the casing 102 in the horizontal direction. The sheet pressing plate 111 can hold a stack of sheets 103 placed thereon. The sheet pressing plate 111 is swingably supported at its end, which is positioned at a distance from the sheet feed mechanism 107, so that the other end, which is positioned near the sheet feed mechanism 107, can swing up and down. The sheet pressing plate 111 is upwardly urged by a spring (not shown) from its underside. With this structure, the sheet pressing plate 111 swings downward against an urging force from the spring about the end, which is provided at a distance from the sheet feed mechanism 107, with increasing an amount of sheets 103 placed thereon.

The sheet feed mechanism 107 includes a sheet feed roller 112, a separation pad 113 facing the sheet feed roller 112, and a spring 114 provided under the separation pad 113 so as to urge the separation pad 113 against the sheet feed roller 112 by its urging force. A topmost sheet 103 in the stack on the sheet pressing plate 111 is pressed against the sheet feed roller 112 by the spring provided under the sheet pressing plate 111. As the sheet feed roller 112 rotates, the topmost sheet 103 is pinched between the sheet feed roller 112 and the sheet feed pad 113 by the rotation of the sheet feed roller 112, thereby feeding the topmost sheet 103. As described above, the sheets 103 in the stack are fed one by one from the feeder unit 104. Then, the fed sheet 103 is further conveyed to the resist rollers 110.

The pair of resist rollers 110 correct a deviation of the fed sheet 103 and further convey the sheet 103 to an image forming position at a predetermined timing. The image forming position is a position at which a photosensitive drum 128 and a transfer roller 131 contact with each other in order to transfer a toner image (visible image) onto the sheet 103.

The feeder unit 104 of the laser-beam printer 101 further includes a multi-purpose tray 115 on which sheets 103 of an arbitrary size are stacked, a multi-purpose sheet feed mechanism 116 that feeds, one by one, the sheets 103 stacked on the multi-purpose tray 115, and a pair of multi-purpose convey rollers 117. The multi-purpose tray 115 can hold a stack of sheets 103 of an arbitrary size thereon.

The multi-purpose sheet feed mechanism 116 includes a multi-purpose sheet feed roller 118, a multi-purpose separation pad 119 facing the multi-purpose sheet feed roller 118, and a spring 120 provided under the multi-purpose separation pad 119. The multi-purpose separation pad 119 is pressed against the multi-purpose sheet feed roller 118 by the urging force from the spring 120.

As the multi-purpose sheet feed roller 118 rotates, a topmost sheet 103 of the stack, which is stacked on the multi-purpose tray 115, is pinched between the multi-purpose sheet feed roller 118 and the multi-purpose separation pad 119 by the rotation of the multi-purpose sheet feed roller 118, thereby separating the topmost sheet 103 from the stack by cooperation of the multi-purpose sheet feed roller 118 and the multi-purpose separation pad 119 and feeding the topmost sheet 103 to the multi-purpose conveyor rollers 117. As described above, the sheets 103 are fed one by one from the stack. The fed sheet 103 is further conveyed to the resist rollers 110.

The image forming unit 105 includes a scanner unit 121, a processing unit 122 as a processing device, and a fixing unit 123.

The scanner unit 121 is provided in an upper portion of the casing 102 and includes a laser-beam emitting portion (not shown), a polygon mirror 124 rotating at a high speed, lenses 125*a*, 125*b*, and a reflector 126. A laser beam emitted from the laser emitting portion, according to image data, passes through or is reflected off the polygon mirror 124, the lens 125*a*, the reflector 126, and the lens 121, in this order, as indicated by a dot-dash line, and then finally irradiates the surface of the photosensitive drum 128.

The processing unit 122 is provided below the scanner unit 121 and is detachably attached to the casing 102. The processing unit 122 has a drum cartridge 127 for rotatably supporting the photosensitive drum 128. The drum cartridge 127 includes the photosensitive drum 128, a Scorotron charging device 130, the transfer roller 131 and a cleaning portion 171.

Figure 8:
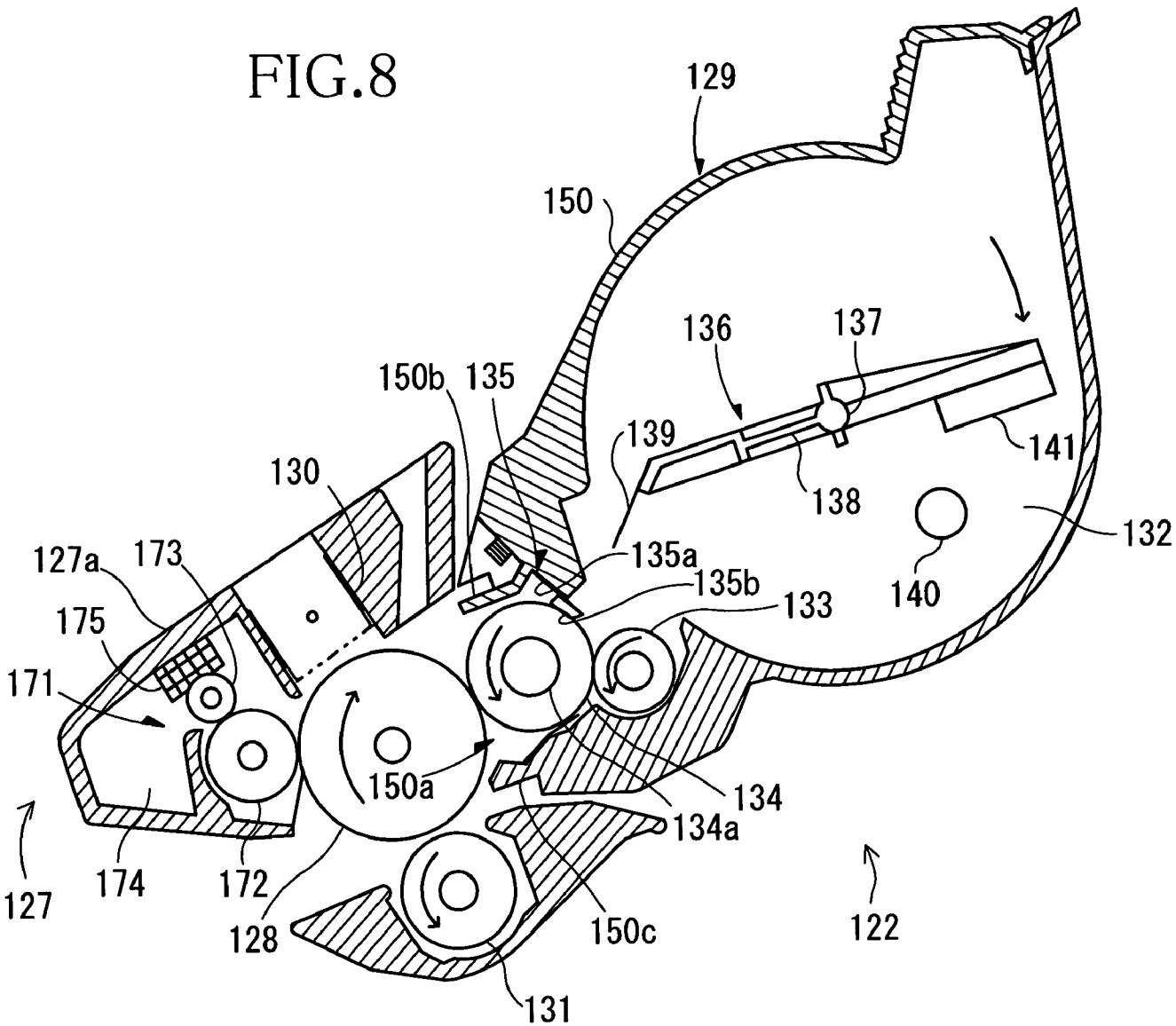
FIG. 8 is a sectional side view showing essential parts of a processing unit used for the laser-beam printer of FIG. 7.

A developing cartridge 129 is detachably attached to the drum cartridge 127. As shown in FIG. 8, the developing cartridge 129 includes a toner hopper 132, a toner supply roller 133 provided next to the toner hopper 132, a developing roller 134, and a layer-thickness regulating blade 135, in its housing 150. The housing 150 has a box shape and is provided with an opening 150*a* at a side.

The toner hopper 132 accommodates positively electrically charged toner of a single non-magnetic component as a developing agent. The toner to be used is polymerized toner that is obtained by copolymerizing monomers, such as styrene-based monomers, for example, styrene, and polymerizable monomers, such as acrylic-based monomers, for example, acrylic acid, alkyl (C1–C4) acrylate, and alkyl (C1–C4) methacrylate, using a known polymerization method, such as a suspension polymerization. Polymerized toner particles are spherical in shape, having excellent fluidity, so that a high-quality image can be formed. The toner is mixed with a coloring material, such as a carbon black, and wax, as well as silica as an external additive to improve the fluidity of the toner. A toner particle size is approximately 6 to 10 μm.

The toner hopper 132 is provided with an agitator 136. The agitator 136 includes a rotating shaft 137 that is rotatably supported at a substantially center of the toner hopper 132, an agitating blade 138 attached to the rotating shaft 137, and a film 139 adhered to a free end of the agitating blade 138. The rotating shaft 137 of the agitator 136 rotates in a direction indicated by an arrow in FIGS. 7 and 8 (in the clockwise direction) by the power transmitted from a main motor (not shown). The agitating blade 138 moves along an inner surface of the toner hopper 132. By moving the agitating blade 138, the film 139 supplies the toner stored in the toner hopper 132 to the toner supply roller 133. A cleaner 141 is attached to the rotating shaft 137 of the agitator 136 in order to clean a window 140 provided in the side wall of the toner hopper 132.

The toner supply roller 133 is supported by the housing 150, next to the toner hopper 132, so as to be rotatable in a direction indicated by an arrow shown in FIGS. 7 and 8 (in the counterclockwise direction). The toner supply roller 133 includes a metal roller shaft covered with a conductive urethane sponge material.

The developing roller 134 is supported by the housing 150, next to the toner supply roller 133, so as to be rotatable in a direction indicated by an arrow shown in FIGS. 7 and 8 (in the counterclockwise direction). The developing roller 134 includes a metal roller shaft 134*a* covered with a conductive elastic material. More specifically, a portion of the developing roller 134 covered with the conductive elastic material formed of conductive urethane rubber or silicone rubber including fine carbon particles whose surface is coated with urethane rubber or silicone rubber including fluorine.

The roller shaft 134*a* of the developing roller 134 is connected to a high-voltage power supply (not shown), and a predetermined developing bias is applied to the developing roller 134. The developing roller 134 rotates in a direction indicated by an arrow shown in FIGS. 7 and 8 (in the counterclockwise direction) by the power transmitted from the main motor.

Figure 10:
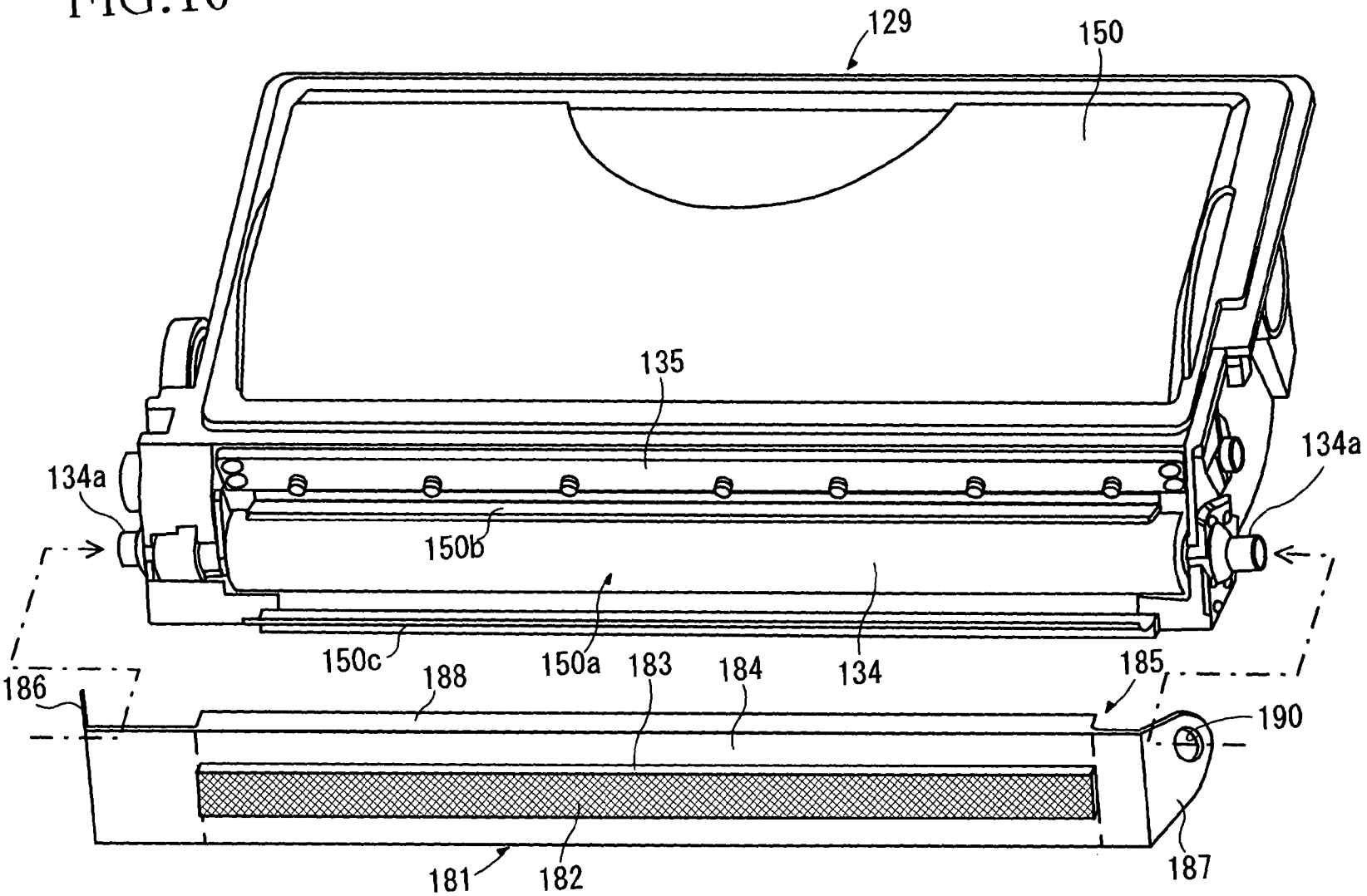
FIG. 10 is a perspective view of a developing cartridge of the processing unit of FIG. 8.

As shown in FIG. 10, the developing roller 134 is disposed so that a part of the developing roller 134 is exposed to the outside from the opening 150*a* in the housing 150. The toner supply roller 133 and the developing roller 134 contact each other so as to apply some pressure to one another at all times.

The layer-thickness regulating blade 135 is provided above the toner supply roller 133 so as to face the developing roller 134 and extend in the axial direction of the developing roller 134. The layer-thickness regulating blade 135 includes a leaf spring member 135*a* and a pressing member 135*b* attached to a free end of the leaf spring member 135*a*. The leaf spring member 135*a* is attached to the housing 150 of the developing cartridge 129. The pressing member 135*b* has a semicircular shape in cross section and is made of insulating silicone rubber. The pressing member 135*b* presses the surface of the developing roller 134 with the elasticity of the leaf spring member 135*a*.

The toner discharged from the toner hopper 132 is supplied to the developing roller 134 by the rotation of the toner supply roller 133. While passing between the toner supply roller 133 and the developing roller 134, the toner is positively charged by the friction produced therebetween. As the developing roller 134 rotates, the toner held by the developing roller 134 enters between the developing roller 134 and the pressing member 135*b* of the layer-thickness regulating blade 135 and becomes a thin layer having uniform thickness on the developing roller 134.

Figure 9:
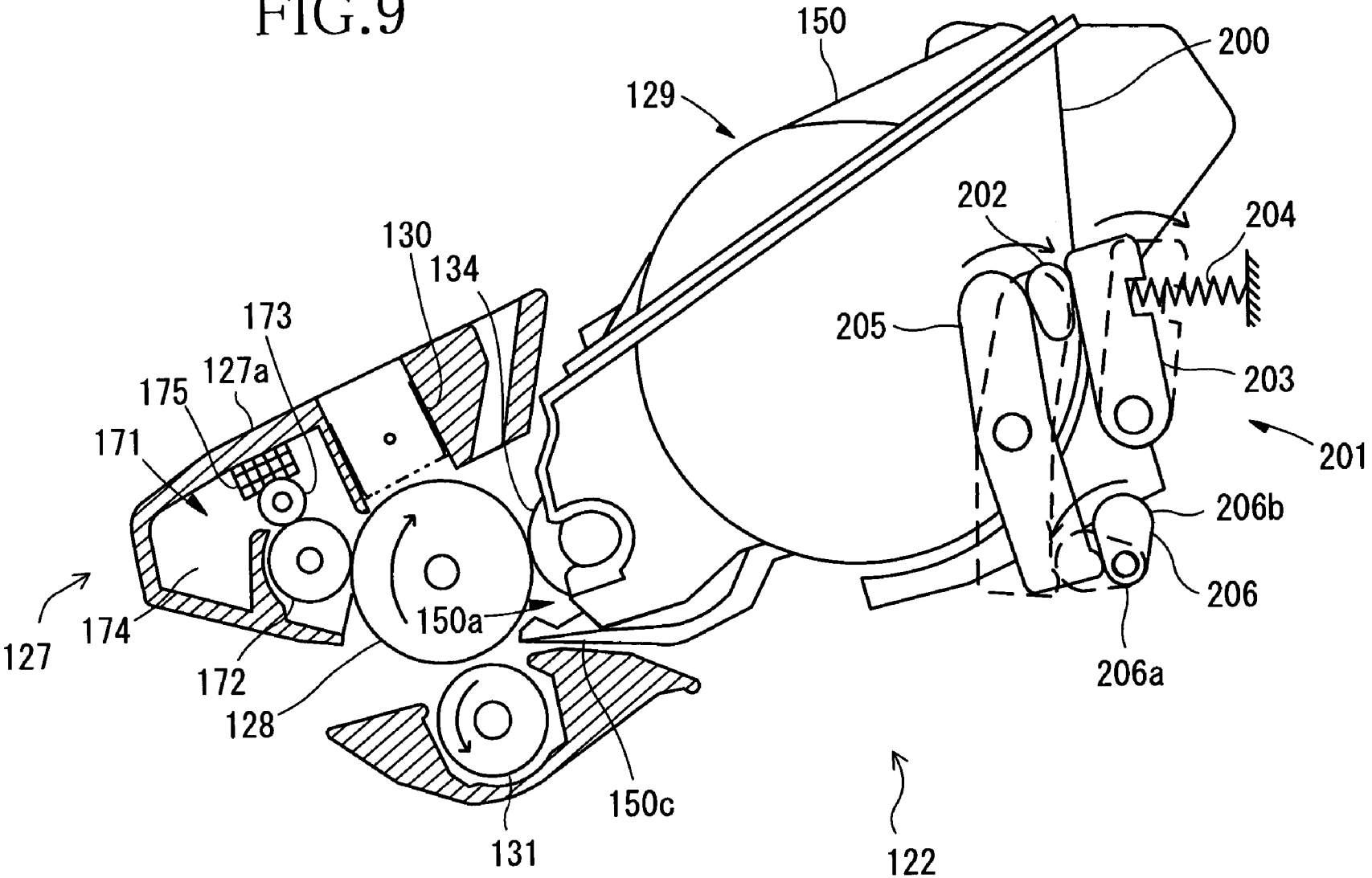
FIG. 9 is a partial sectional side view showing essential parts of an engaging and disengaging mechanism of the processing unit of FIG. 8.

As shown in FIG. 9, the laser-beam printer 101 further includes an engaging and disengaging mechanism 201 that moves the developing cartridge 129, attached to the drum cartridge 127, in the substantially horizontal direction. The developing cartridge 129 can move between an engaged position at which the developing roller 134 contacts the photosensitive drum 128 and a disengaged position at which the developing roller 134 is positioned at a distance from the photosensitive drum 128.

The engaging and disengaging mechanism 201 includes an engaging portion 202 horizontally protruding from the housing 150 of the developing cartridge 129, a pressing plate 203 provided to the casing 102, a pressing spring 204, a swing plate 205, and a cam 206.

A lower end of the pressing plate 203 is swingably supported by the casing 102 and an upper end of the pressing plate 203 is engaged with one end of the pressing spring 204. The other end of the pressing spring 204 is fixed to the casing 102. The upper portion of the pressing plate 203 is urged toward the photosensitive drum 128 by the urging force from the pressing spring 204.

The swing plate 205 is rotatably supported at its center. A lower portion of the swing plate 205 is in contact with the cam 206 rotatably supported by the casing 102. When a thin portion 206*a* of the cam 206 contacts the lower portion of the swing plate 205, as shown by a solid line, the upper portion of the swing plate 205 swings toward the photosensitive drum 128. When a thick portion 206*b* of the cam 206 contacts the lower portion of the swing plate 205, as shown by a dashed line, the upper portion of the swing plate 205 swings in a direction shown by an arrow in FIG. 9, so that the upper portion of the swing plate 205 moves in a direction to be distanced from the photosensitive drum 128.

When the developing cartridge 129 is attached to the casing 102 with the drum cartridge 127 attached, the engaging portion 202 of the developing cartridge 129 is pinched between the pressing plate 203 and the swing plate 205. During the development, by rotating the cam 206 by the power transmitted from an engaging and disengaging motor (not shown), the thin portion 206a of the cam 206 is brought into contact with the lower potion of the swing plate 205.

Then, the pressing plate 203 presses the engaging portion 202 toward the photosensitive drum 128 by the urging force from the pressing spring 204. At that time, the swing plate 205 also swings toward the photosensitive drum 128 and, thus, the thin portion 206*a* of the cam 206 contacts the lower portion of the swing plate 205 as shown by the solid line in FIG. 9. As described, as the engaging portion 202 moves in the direction toward the photosensitive drum 128, the whole developing cartridge 129 also moves in the same direction and the developing roller 134 moves to the engaged position where the developing roller 134 contacts the photosensitive drum 128.

When the development is not performed, the thick portion 206*b* of the cam 206 is brought into contact with the lower portion of the swing plate 205 by rotating the cam 206, the upper portion of the swing plate 205 swings in the direction to be away from the photosensitive drum 128 to press the engaging portion 202 toward the direction to dissociate from the photosensitive drum 128, as shown by the dashed line in FIG. 9, against the urging force. At that time, pressing plate 203 also moves in the same direction, against the urging force from the pressing spring 204, together with the engaging portion 202. Thus, as described, as the engaging portion 202 moves in the direction to dissociate from the photosensitive drum 128. Further, the whole developing cartridge 129 also moves in the same direction and the developing roller 134 moves to the disengaged position where the developing roller 134 is positioned at a distance from the photosensitive drum 128.

As shown in FIG. 8, the photosensitive drum 128 is supported next to the developing roller 134 by a housing 127*a* of the drum cartridge 127 so as to face the developing roller 134. The photosensitive drum 128 rotates in a direction indicated by an arrow (in the clockwise direction). The photosensitive drum 128 includes an aluminum drum body, in the form of a tube, which is grounded. The surface of the drum body is coated by a positively-charged photosensitive layer made of polycarbonate.

The Scorotron charging device 130 is supported above the photosensitive drum 128 by the housing 127*a* of the drum cartridge 127, with a predetermined space provided between the Scorotron charging device 130 and the photosensitive drum 128. The Scorotron charging device 130 generates corona discharge from tungsten wires to positively charge the surface of the photosensitive drum 128. The Scorotron charging devise 130 is connected to a high-voltage power supply (not shown).

As the photosensitive drum 128 rotates, its surface is uniformly positively charged by the Scorotron charging device 130. Then, the surface of the photosensitive drum 128 is exposed to a laser beam emitted from the scanner unit 121 to form an electrostatic latent image based on image data. At that time, the developing cartridge 129 is positioned at the engaged position and is in contact with the photosensitive drum 128. Positively-charged toner held by the surface of the developing roller 134 adheres to the electrostatic latent image formed on the photosensitive drum 128 when contacting the latent image on the photosensitive drum 128, thereby forming an visible image.

The transfer roller 131 is supported below the photosensitive drum 28, in the housing 127*a* of the drum cartridge 127, so as to face the photosensitive drum 28. The transfer roller 131 rotates in a direction indicated by an arrow in FIG. 8 (in the counterclockwise direction) by the power transmitted from a main motor (not shown). A predetermined transfer bias is applied to the transfer roller 131 from a high-voltage power supply (not shown).

The cleaning portion 171 is provided in the housing 127*a* of the drum cartridge 127 so as to face the developing roller 134 while sandwiching the photosensitive drum 128 therebetween. The cleaning portion 171 includes a first cleaning roller 172, a second cleaning roller 173, a paper dust storage portion 174, and a scraper 175.

The first cleaning roller 172 is disposed downstream of the transfer roller 131 and in the rotational direction of the photosensitive drum 128 when facing the transfer roller 131 and upstream of the Scorotron charging device 130 in the rotational direction of the photosensitive drum 128 when facing the Scorotron charging device 130, so as to contact the photosensitive drum 128. The first cleaning roller 172 includes a roller shaft covered with a conductive foam member, such as a silicone rubber foam, urethane foam rubber, or EPDM foam.

The second cleaning roller 173 is in contact with the first cleaning roller 172 and faces the photosensitive drum 128 while sandwiching the first cleaning roller 172 therebetween. The second cleaning roller 173 includes a roller shaft and a metal member which integrally provided around the roller shaft.

The paper dust storage portion 174 is a space defined by the housing 127*a* of the drum cartridge 127, facing the first cleaning roller 172 while sandwiching the second cleaning roller 173 therebetween.

The scraper 175 is supported above the second cleaning roller 173 by the housing 127*a* of the drum cartridge 127 so as to be in contact with the second cleaning roller 173. The scraper 175 is made of a foam material, such as urethane. The scraper 175 wipes and removes paper dust from the second cleaning roller 173, and the collected paper dust is stored in the paper dust storage portion 174.

The toner image held by the surface of the photosensitive drum 128 is transferred onto the sheet 103, which is conveyed by the resist rollers 110, when passing between the photosensitive drum 128 and the transfer roller 131. Then, the sheet 103 having the toner image is conveyed to the fixing unit 123 via a conveyor belt 142, as shown in FIG. 7.

As shown in FIG. 7, the fixing unit 123 is disposed next to and downstream of the processing unit 127 in the sheet conveying direction. The fixing unit 123 includes a heat roller 143, a pressing roller 144, and a pair of conveyor rollers 145.

The heat roller 143 includes a metal hollow tube which contains a halogen lamp. The surface of the tube is coated with a fluorine-based resin. The pressing roller 144 is disposed under the heat roller while pressed against the heat roller 143. The conveyor rollers 145 are disposed downstream of the heat roller 143 and the pressing roller 144 in the sheet conveying direction.

The toner adhering to the sheet 103, which reaches the fixing unit 123, is melted by the heat and fixed on the sheet 103 while the sheet 103 passes between the heat roller 143 and the pressing roller 144. After that, the sheet 103 is conveyed to a pair of conveyor rollers 146 and a pair of sheet ejection rollers 147 provided in the casing 102, by the conveyor rollers 145.

The conveyor rollers 146 are disposed downstream of the conveyor rollers 145 in the sheet conveying direction. The sheet ejection rollers 147 are disposed above an output tray 148. The sheet 103 conveyed by the conveyor rollers 145 is further conveyed to the sheet ejection rollers 147 by the conveyor rollers 146 and, then, is ejected onto the output tray 148 by the sheet ejection rollers 147.

In the laser-beam printer 101 of the second embodiment, the residual toner on the surface of the photosensitive drum 128 is collected by the developing roller 134 after the toner image is transferred onto the sheet 103 by the transfer roller 131 and the collected toner is reused for future development. With this structure, there is no need to provide a blade for wiping off residual toner and a waste toner storage box for storing the collected residual toner, thereby reducing the number of parts and downsizing the laser-beam printer 101.

Because polymerized toner having excellent fluidity and a sphere shape is used in the laser-beam printer 101 of this embodiment, it is difficult to remove residual toner from the photosensitive drum 108 by using a blade. Accordingly, it is essential that the laser-beam printer 101 is designed to collect residual toner as described above because of the use of the polymerized toner.

In the laser-beam printer 101 of this embodiment, paper dust adhering to the surface of the photosensitive drum 128 is collected during the transfer of an image as well as temporarily collecting the residual toner remaining on the surface of the photosensitive drum 128 by the cleaning portion 171 after the transfer of the image. This method is disclosed in U.S. patent application Ser. No. 10/394,197, the disclosure of which is incorporated by reference in its entity.

At the cleaning portion 171, the residual toner and paper dust remaining on the photosensitive drum 128 are electrically caught by the first cleaning roller 172. The toner collected by the cleaning roller 172 is electrically fed back to the photosensitive drum 128, and the paper dust collected by the cleaning roller 172 is electrically caught by the second cleaning roller 173. Therefore, the paper dust can be efficiently removed from the photosensitive drum in parallel with the collection of residual toner.

Then, the paper dust collected by the second cleaning roller 173 is wiped and removed from the second cleaning roller 173 by the scraper 175 and the removed paper dust is stored in the paper dust storage portion 174 without scattering. Thus, the paper dust, which has been removed from the photosensitive drum 128, can be prevented from adhering to the surface of the photosensitive drum 128 again, thereby improving the image quality. In addition, the paper dust collected by the second cleaning roller 173 is wiped therefrom and removed by the scraper 175, so that the capability of the second cleaning roller 173 to capture paper dust can be maintained for the long time.

The laser-beam printer 101 of this embodiment further includes a reconveyance unit 151 for forming an image on both sides of a sheet 103. The reconveyance unit 151 includes a sheet reverse mechanism 152 and a reconveyance tray 153, which are integral with each other. The sheet reverse mechanism 152 is externally detachably attached to the laser-beam printer 101 from the rear of the casing 102 with the reconveyance tray 153 inserted above the feeder unit 104.

The sheet reverse mechanism 152 is externally attached to the rear wall of the casing 102 and includes a casing 154 having a rectangular shape in cross section, a pair of sheet reverse rollers 156 and a pair of reconveyance rollers 157. A sheet reverse guide plate 158 upwardly protrudes from the upper end of the sheet reverse mechanism 152.

A flapper 155 is provided downstream of the conveyor rollers 145 in the sheet conveying direction. The flapper 155 is selectively changed between a state for conveying the sheet 103, which is conveyed from the conveyor rollers 145, toward the conveyor rollers 146 (shown by a solid line in FIG. 7) and a state for conveying the sheet 103 toward the sheet reverse rollers 156 (shown by a dashed line in FIG. 7).

The flapper 155 is swingably supported at the rear part of the casing 102, and near to and downstream of the conveyor rollers 145 in the sheet conveying direction. The state of the flapper 155 is changed by the energization and deenergization of a solenoid (not shown).

The sheet reverse rollers 156 are provided at the upper portion of the casing 154 and downstream of the flapper 155 in the sheet conveying direction. The sheet reverse rollers 156 can rotate in a normal direction and in a reverse direction. First, the sheet reverse rollers 156 rotate in the normal direction to convey the sheet 103 toward the sheet reverse guide plate 158 and then rotate in the reverse direction to convey the sheet 103 in the reverse direction.

The reconveyance rollers 157 are provided under the sheet reverse rollers 156 in the casing 154 and downstream of the sheet reverse rollers 156. The reconveyance rollers 157 convey the sheet 103, whose conveying direction is reversed by the sheet reverse roller 156, to the reconveyance tray 153. The sheet reverse guide plate 158 includes a plate member extending upward from the upper portion of the casing 154 to guide the sheet 103 conveyed by the sheet reverse rollers 156.

Next, the operation for forming an image on both sides of a sheet 103 will be described. It is assumed that the sheet 103 already has an image on one surface. The state of the flapper 155 is changed to the state of conveying the sheet 103 toward the sheet reverse rollers 156 and the sheet 103 having an image on one surface is received by the sheet reverse mechanism 152. Then, as the sheet 103 reaches the sheet reverse rollers 156, the sheet reverse rollers 156 rotate in the normal direction, pinching the sheet 103 therebetween, in order to upwardly convey the sheet 103 to the outside once along the sheet reverse guide plate 158. When most of the sheet 103 is outputted to the outside and the trailing edge of the sheet 103 is pinched by the sheet reverse rollers 156, the sheet reverse rollers 156 stop rotating in the normal direction.

Then, the sheet reverse rollers 156 rotate in the reverse direction to convey the sheet 103 to the reconveyance rollers 157 so that the sheet 103 is conveyed downward to be positioned upside down. The rotating direction of the sheet reverse rollers 156 is changed from the normal direction to the reverse direction after a predetermined time interval lapses following detection by a sheet passage sensor 166, disposed downstream of the fixing unit 123 in the sheet conveying direction, of the passage of the trailing edge of the sheet 103.

As the conveyance of the sheet 103 to the sheet reverse rollers 156 is completed, the state of the flapper 155 is changed to the state of conveying the sheet 103 to the conveyor rollers 146. Then, the sheet 103, which reached the reconveyance rollers 157 in an upside down state, is further conveyed to the reconveyance tray 153 by the reconveyance rollers 157. The reconveyance tray 153 includes a sheet supply portion 159, a tray body 160 and skewed rollers 161.

The sheet supply portion 159 is provided below the sheet reverse mechanism 152 and is externally attached to the rear part of the casing 102. The sheet supply portion 159 includes a sheet guide member 162 having a curved shape. At the sheet supply portion 159, the sheet 103 is guided by the sheet guide member 162 so that the conveying direction of the sheet 103, which is being conveyed in the vertical direction from the reconveyance rollers 157, becomes a substantially horizontal direction. Then the sheet 103 is further conveyed toward the tray body 160 in the substantially horizontal direction.

The tray body 160 has a substantially rectangular shape and extends in the substantially horizontal direction above the sheet tray 106. An upstream side end of the tray body 160 is coupled with the sheet guide member 162, and a downstream side end of the tray body 160 is coupled with an upper end of a reconveying passage 163 extending to the conveyor rollers 109.

Two pairs of skewed rollers 161 are provided at a predetermined interval in the sheet conveying direction, at the middle of the sheet conveying direction in the tray body 160. The skewed rollers 161 make the sheet 103 contact with a reference plate (not shown) at all times during the conveyance of the sheet 103.

Each pair of skewed rollers 161 includes a drive roller 164 and a following roller 165. The drive roller 164 is disposed near the reference plate (not shown) provided at one end of the tray body 160 in its width direction, its axis extends in a direction substantially perpendicular to the sheet conveying direction. The following roller 165 faces the drive roller 164 while sandwiching the sheet 103 therebetween and its axis slantingly extends so that the sheet conveying direction extends from the direction substantially perpendicular to the sheet conveying direction to a direction toward the reference plane.

The sheet 103 fed to the tray body 160 from the sheet supply portion 159 is further conveyed by the skewed rollers 161 while one end of the sheet 103 in the width direction is in contact with the reference plate. The sheet 103 is conveyed to the image forming position again via the reconveying passage 163 and the conveyor rollers 109. Then, a toner image is transferred onto the other side (rear surface) of the sheet 103 when the sheet 103 passes between the photosensitive drum 128 and the transfer roller 131. After that, the toner image is fixed on the other side of the sheet 103 by the fixing unit 123 and the sheet 103, having the images on the both surfaces, is ejected onto the output tray 148.

The laser-beam printer 101 of this embodiment is provided with an openable upper cover 149 at the casing 102. The processing unit 122 and the developing cartridge 129 can be attached to and detached from the laser-beam printer 101 via the upper cover 149.

In the laser-beam printer 101 of this embodiment, paper dust adhering to the surface of the photosensitive drum 128 is removed at the cleaning portion 171. The sheets 103 contain additives, such as a filler, a paper durability promoter, and a sizing agent, as well as fibers.

The filler is a hard additive that makes the composition of paper dense and improves opacity, whiteness, and smoothness of the paper. Calcium carbonate, kaolin (china clay), or talc can be used as the filler. The paper durability promoter is an additive that makes the durability of the paper strong. The sizing agent is an additive that reduces absorption of liquid, such as ink, to prevent the ink from spreading on the paper. Alkyl ketene dimer or alkenyl succinic anhydride can be used as the sizing agent.

Figure 12:
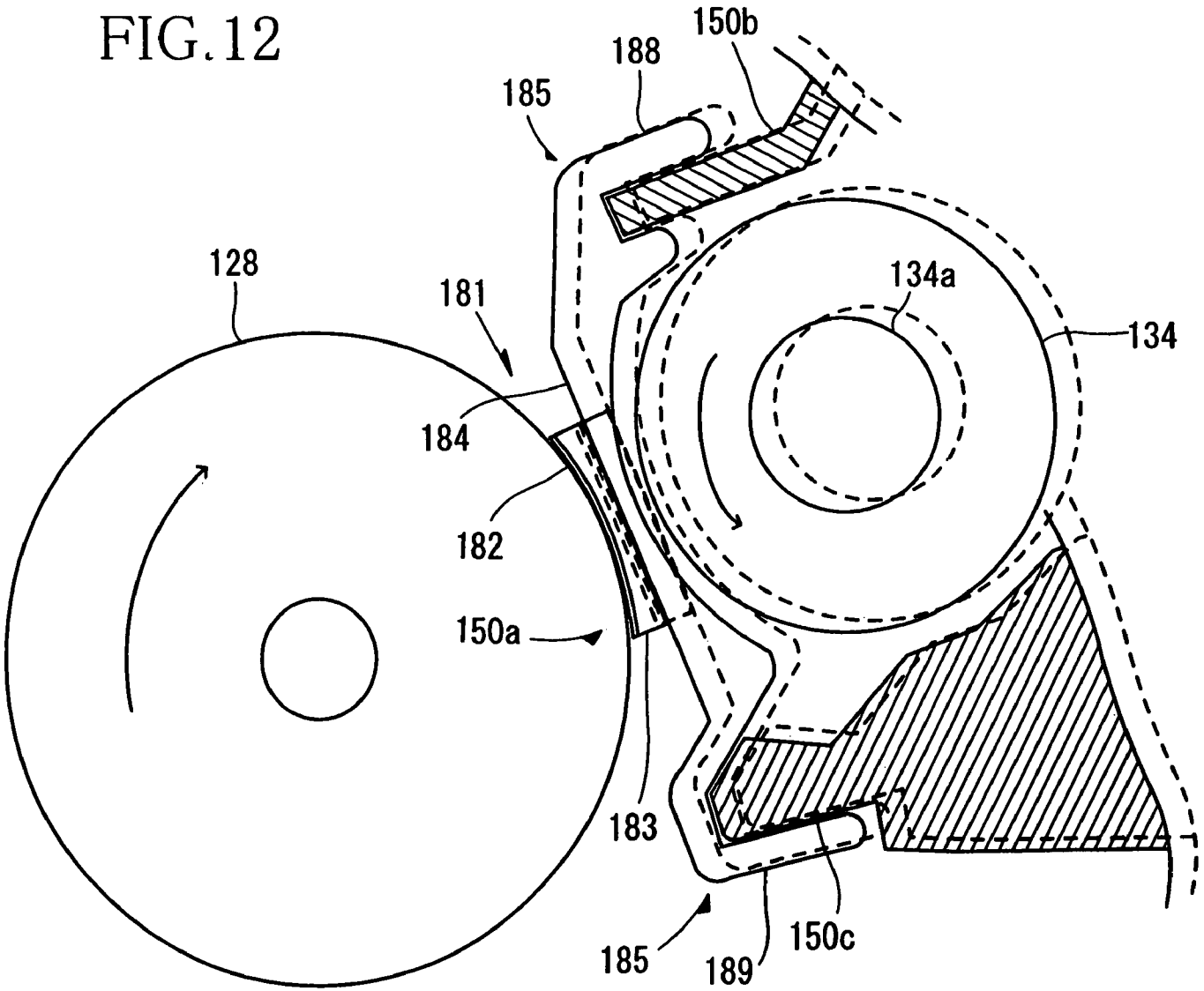
FIG. 12 is an enlarged sectional side view showing essential parts of the processing unit of FIG. 1.

Recycled paper, which is used more often today, contains high amounts of such additives. However, when such additives adhere to the surface of the photosensitive drum 128, there may be a case where the paper dust and the additives cannot be cleanly removed by the first cleaning roller 172. In order to avoid this problem, the laser-beam printer 101 of the second embodiment includes a contaminant removing member 181 for removing contaminants (including additives described above) adhering to the surface of the photosensitive drum 128, which is detachably attached to the developing cartridge 129, as shown in FIGS. 10 and 12.

As shown in FIG. 10, the contaminant removing member 181 includes a contaminant removing portion 182 as a contact portion contacting the surface of the photosensitive drum 128, a sponge member 183, which is an elastic body to which the contaminant removing portion 182 is adhered, a support portion 184, which supports the contaminant removing portion 182 and the sponge member 183, and an attaching portion 185, which is used to detachably attach the contaminant removing member 181 to the developing cartridge 129.

The contaminant removing portion 182 is made of, for example, paper, wrapping paper, felt or nonwoven fabric. It is preferable that the contaminant removing portion 182 is made of paper and has a substantially rectangular shape. The contaminant removing portion 182 has a length, which is shorter than or equal to the roller material of the developing roller 134 and longer than or equal to the length of the image forming area of the photosensitive drum 128 in the axial direction of the photosensitive drum 128. Because the length of the contaminant removing portion 182 is longer than or equal to the length of the image forming area of the photosensitive drum 128, contaminants adhering to the image forming area of the photosensitive drum 128 can be surely removed.

The contaminant removing portion 182, which is made by laminating fiber materials and whose surface is uneven, is preferably used. The projections in the contaminant removing portion 182 wipe and remove contaminants or foreign matters from the surface of the photosensitive drum 128 by frictionally sliding over the surface of the photosensitive drum 128, and the gaps between the fibers catch and hold the contaminants therein. Because the contaminant removing portion 182 is formed by laminating the fiber materials on one another, a plurality of projections and gaps are provided at extremely small intervals. With this structure, the contaminant removing portion 182 can efficiently remove the contaminants from the surface of the photosensitive drum 128.

It is preferable that paper made by skimming fiber materials, such as cellulosic fiber, is used as the contaminant removing portion 182. The surface of such paper is uneven such that projections and gaps are developed like a mesh, so that the paper has high removability of contaminants. In addition, because the cellulosic fiber itself has an irregular structure, the removability of contaminants is further increased.

Furthermore, when paper, which is made from 100% virgin pulp with 15% or less by weight of a filler mixed therein, is used as the contaminant removing portion 182, additives adhering to the surface of the photosensitive drum 128 can be more effectively removed.

When recycled paper made from 100% recycling materials is used as the contaminant removing portion 182, the surface of the photosensitive drum 128 is easily damaged as compared with the virgin paper with a filler mixed therein. Because the recycled paper contains impurities, which damage the surface of the photosensitive drum 128, it is not preferable that the recycled paper be used as the contaminant removing portion 182.

Wrapping paper is made by which hard materials are dusted onto a sheet and fixed thereon. Therefore, projections and gaps are randomly developed on the paper. Accordingly, the removability of contaminants using wrapping paper compares unfavorably with that of the virgin paper.

The contaminant removing portion 182 may be made of felt, which is made by which chemical fibers, such as nylon, polypropylene, and acrylic fibers, are woven. Unevenness (projections and gaps) is developed in the felt by weaving chemical fibers, so that contaminants adhering to the photosensitive drum 128 can be removed.

The sponge member 183 is made of urethane sponge to which double-sided adhesive tapes are adhered on both sides. The sponge member 183 has a narrow rectangular shape, which is the substantially same shape as the contaminant removing portion 182. The thickness of the sponge member 183 is greater than that of the contaminant removing portion 182.

The support portion 184 is made of hard resin and has a substantially narrow rectangular shape. The height (the side in the direction perpendicular to the longitudinal direction) of the support portion 184 is greater than that of the contaminant removing portion 182.

The contaminant removing portion 182 is provided on the surface of the support portion 184 via the sponge member 183, along the width direction of the support portion 184. More particularly, the double-sided adhesive tape of the sponge member 183 is adhered to the surface of the support portion 184 centered in the up and down direction. The contaminant removing portion 182 is adhered to the double-sided adhesive tape on the other side of the sponge member 183.

As shown in FIG. 12, the reserve side of the support portion 184 is concavely curved like an arc wherein the thickness of the support portion 184 becomes gradually thinner toward what is substantially the middle of the support portion 184, when viewed from the side. The arc portion of the support portion 184 and the developing roller 134 are concentric circles. In a state where the support potion 184 is attached to the developing cartridge 129, the surface of the reverse side of the support portion 184 does not contact the developing roller 134.

Figure 11:
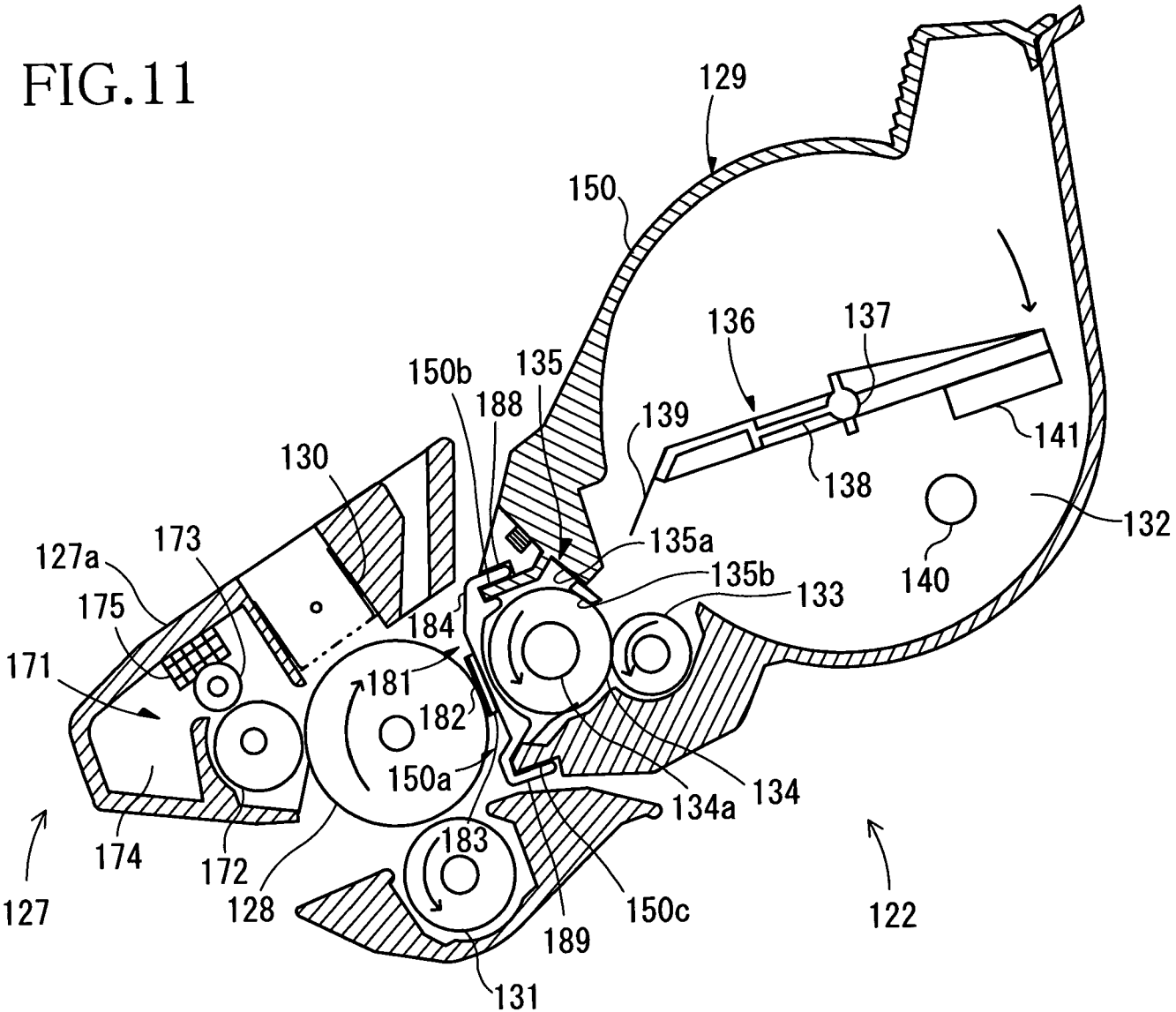
FIG. 11 is a sectional side view showing essential parts of the processing unit of FIG. 8 having a contaminant removing member.

The attaching portion 185, made of hard resin, is integrally formed with the support portion 184. As shown in FIGS. 10 and 11, the attaching portion 185 includes a left attaching portion 186 and a right attaching portion 187 provided at the left and right ends of the support portion 184 in the longitudinal direction, respectively, and an upper engaging portion 188 and a lower engaging portion 189 provided at the upper and lower ends of the support portion 184, respectively.

The plate-shaped left and right attaching portions 186, 187 are bent at the substantially right angle so as to extend toward the developing cartridge 129 from the respective ends of the support portion 184 when attached to the developing cartridge 129. An insertion hole 190 is provided in the left and right attaching portions 186, 187 so that the ends of the roller shaft 134*a* of the developing roller 134 are inserted into the insertion holes 190.

The plate-shaped upper and lower engaging portions 188, 189 extend along the longitudinal sides of the support potion 184 so as to face the developing roller 134 when attached to the developing cartridge 129. The upper and lower engaging potions 188, 189 are bent at the substantially a right angle so as to extend toward the developing cartridge 129 from the upper and lower sides of the support portion 184 when attached to the developing cartridge 129. As shown in FIG. 12, the upper engaging portion 188 has a substantially C-shape in cross section so as to be able to engage an upper end portion 150*b* of the housing 150 defining the opening 150*a*. The lower engaging portion 189 has a substantially trapezoidal shape in cross section so as to engage a lower end portion 150*c* of the housing 150 defining the opening 150*a*.

The contaminant removing member 181 structured as described above is attached to the developing cartridge 129, and then the developing cartridge 129 attached with the contaminant removing member 181 is attached to the drum cartridge 127.

In order to attach the contaminant removing member 181 to the developing cartridge 129, as shown in FIG. 10, each end of the roller shaft 134*a* of the developing roller 134 is inserted into a respective insertion hole 190 of the right and left attaching portions 187, 186 while the support portion 184 faces the developing roller 134. At the same time, the upper engaging portion 188 and the lower engaging potion 189 are engaged with the upper end portion 150*b* and the lower end portion 150*c* of the housing 150, respectively. By doing so, the contaminant removing member 181 is attached to the housing 150 and covers the opening 150*a* of the housing 150 and the surface of the developing roller 134.

In the state where the contaminant removing member 181 is attached to the developing cartridge 129, as shown in FIG. 12, the contaminant removing portion 182, mounted on the support potion 184, is exposed to the outside on the support portion 184 and a slight clearance is provided between the support portion 184 and the developing roller 134. Because the clearance is left between the support portion 184 and the developing roller 134, the developing roller 134 is prevented from being damaged by the contaminant removing member 181.

The developing cartridge 129, with the contaminant removing member 181 attached, is then attached to the drum cartridge 127 through an opening, which appears when the upper cover 149 is open, as shown in FIG. 11. In this state, the contaminant removing member 181 is positioned downstream of the Scorotron charging device 130 and upstream of the transfer roller 131 in the rotational direction of the photosensitive drum 128. The contaminant removing member 181 is positioned between the photosensitive drum 128 and the developing roller 134.

In this state, the surface of the contaminant removing potion 182 faces the surface of the photosensitive drum 128 along the axial direction of the photosensitive drum 128. The contaminant removing member 181 moves in accordance with the application and release of the urging force from the engaging and disengaging mechanism 201. When the urging force is applied by the engaging and disengaging mechanism 201, the contaminant removing portion 182 is located at the engaged position where the surface of the contaminant removing portion 182 is in contact with the surface of the photosensitive drum 128 (the position shown by a solid line in FIG. 12). When the urging force is not applied, the contaminant removing portion 182 is located at the disengaged position where the surface of the contaminant removing portion 182 is at a distance from the surface of the photosensitive drum 128 (the position shown by a dashed line in FIG. 12).

In order to remove contaminants and additives from the surface of the photosensitive drum 128 using the contaminant removing member 181, the developing cartridge 129 is moved to the engaged position by the engaging and disengaging mechanism 201. Then, as shown in FIG. 12 by the solid line, the contaminant removing member 181 is pressed toward the surface of the photosensitive drum 128, together with the developing cartridge 129, and the surface of the contaminant removing portion 182 contacts the surface of the photosensitive drum 128. The contaminant removing portion 182 contacts and presses the surface of the photosensitive drum 128 with a relatively strong pressure while pressed by the engaging and disengaging mechanism 201.

When the photosensitive drum 128 is rotated under this condition, contaminants and additives adhering to the surface of the photosensitive drum 128 are excellently wiped and removed from the photosensitive drum 128. In the laser-beam printer 101 of this embodiment, a warm-up is automatically started and the photosensitive drum 128 is rotated when the upper cover 149 is closed from the open state.

After the warm-up is completed in the laser-beam printer 101, the engaging and disengaging mechanism 201 moves the developing cartridge 129 to the disengaged position. Then, as shown in FIG. 12 by the dashed line, the contaminant removing member 181 is disengaged from the photosensitive drum 128.

In order to detach the contaminant removing member 181 from the developing cartridge 129, first, the upper cover 149 of the laser-beam printer 101 is opened and the developing cartridge 129, positioned at the disengaged position, is detached from the drum cartridge 127. Then, each end of the roller shaft 134*a* of the developing roller 134 is released from the respective insertion holes 190 at the left and right attaching portions 186, 187. At the same time, the upper engaging portion 188 and the lower engaging portion 189 of the support portion 184 are disengaged from the upper end portion 150*b* and the lower end portion 150*c* of the housing 150, respectively. By doing so, the contaminant removing member 181 is detached from the developing cartridge 129. Thus, the contaminant removing member 181 can be kept as a single unit.

As described above, in the laser-beam printer 101 of the second embodiment, the contaminant removing member 181 can be easily attached to and detached from the developing cartridge 129. Only when it is desired to remove contaminants from the photosensitive drum 128, the contaminant removing member 181 is attached to the developing cartridge 129. The contaminant removing portion 182 of the contaminant removing member 181 is pressed against the photosensitive drum 128 with a relatively strong pressure, so that contaminants adhering to the photosensitive drum 128 can be effectively removed.

When not performing the cleaning operation (the removal of contaminants), it is necessary to detach the contaminant removing member 181 from the developing cartridge 129. By doing so, the contaminants can be easily and surely removed from the photosensitive drum 128 while damage to the surface of the photosensitive drum 128, which may result from the contact of the contaminant removing member 181 and the photosensitive drum 128, can be minimized.

In the laser-beam printer 101, when the developing cartridge 129 having the contaminant removing member 181 is attached to the drum cartridge 127, the contaminant removing member 181 is positioned between the photosensitive drum 128 and the developing roller 134 and it becomes possible to contact the surface of the photosensitive drum 128. Because the contaminant removing member 181 is located at this position, the contaminant removing member 181 is surely pressed toward the photosensitive drum 128 from the developing roller 134 side by the engaging and disengaging mechanism 201 and, thus, the contaminant removing member 181 contacts and presses the surface of the photosensitive drum 128. Accordingly, contaminants adhering to the photosensitive drum 128 are surely removed.

When the contaminant removing member 181 is moved to the disengaged position by the engaging and disengaging mechanism 201, the contaminant removing member 181 is disengaged from the surface of the photosensitive drum 128. Therefore, damage to the photosensitive drum 28 can be reduced.

Because the support portion 184 of the contaminant removing member 181 is made of hard resin, the contaminant removing portion 182 is tightly supported by the support portion 184. Therefore, the photosensitive drum 128 can be pressed by the contaminant removing portion 182 with a strong pressure and, thus, contaminants can be further surely removed from the photosensitive drum 128.

Further, because the contaminant removing portion 182 of the contaminant removing member 181 is supported by the support portion 184 via the sponge member 183, the contaminant removing portion 182 resiliently contacts the surface of the photosensitive drum 128 while maintaining the strong pressure against the photosensitive drum 128. Accordingly, the contaminants can be further surely removed from the photosensitive drum 128.

The removability of the contaminant removing portion 182 may be degraded due to the accumulation of the contaminants on the surface of the contaminant removing portion 182. When such a case happens, the contaminant removing portion 182, on which the contaminants are accumulated, is removed from the sponge member 183 and replaced with a new contaminant removing portion 182. By doing so, the contaminant removability of the contaminant removing portion 182 can be easily restored.

The attaching portion 185 of the contaminant removing member 181 allows the contaminant removing member 181 to be surely attached to and detached from the developing cartridge 129. Accordingly, the operating efficiency of attachment and detachment of the contaminant removing member 181 is improved.

The contaminant removing member 181 is attached to the developing cartridge 129 so as to cover the opening 150*a* of the housing 150 of the developing cartridge 129 by engaging the upper engaging portion 188 and the lower engaging portion 189 of the attaching portion 185 with the upper end portion 150*b* and the lower end portion 150*c*, respectively. As described above, the contaminant removing member 181 can double as a cover for covering the developing roller 134. Therefore, the contaminant removing member 181 can be used as a cover when the developing cartridge 129 is sold as a replacement item.

The contaminant removing portion 182 can remove contaminants, which cannot be removed by the cleaning portion 171, from the photosensitive drum 128, so that an image forming operation can be performed with a high quality.

The removing of contaminants from the photosensitive drum 128 by the contaminant removing member 181 is performed at an appropriate timing, that is, the time at which an image quality is degraded due to adhesion of contaminants to the photosensitive drum 128. The image quality can be determined by the number of white dots appearing in solid printing. For example, the contaminant removal operation is performed by attaching the contaminant removing member 181 to the developing cartridge 129 after 1000 to 5000 sheets of printing is performed. The photosensitive drum 128 has a lifespan of up to approximately 15000 copies, so that it is enough to perform the contaminant removing operation 3 to 15 times until the photosensitive drum 128 comes to the end of its lifetime.

In the second embodiment described above, the contaminant removing member 181 is attached to the developing cartridge 129 by engaging the upper engaging portion 188 and the lower engaging portion 189 with the upper end portion 150*b* and the lower end portion 150*c*, respectively, so as to cover the opening 150*a* of the housing 150 of the developing cartridge 129. However, the structure of the contaminant removing member 181 is not restricted to the specific structure described above. The contaminant removing member 181 can be designed so as to attach the developing cartridge 129 by engaging with the upper end portion 150*b* of the housing 150 only, as shown in FIG. 13.

Figure 13:
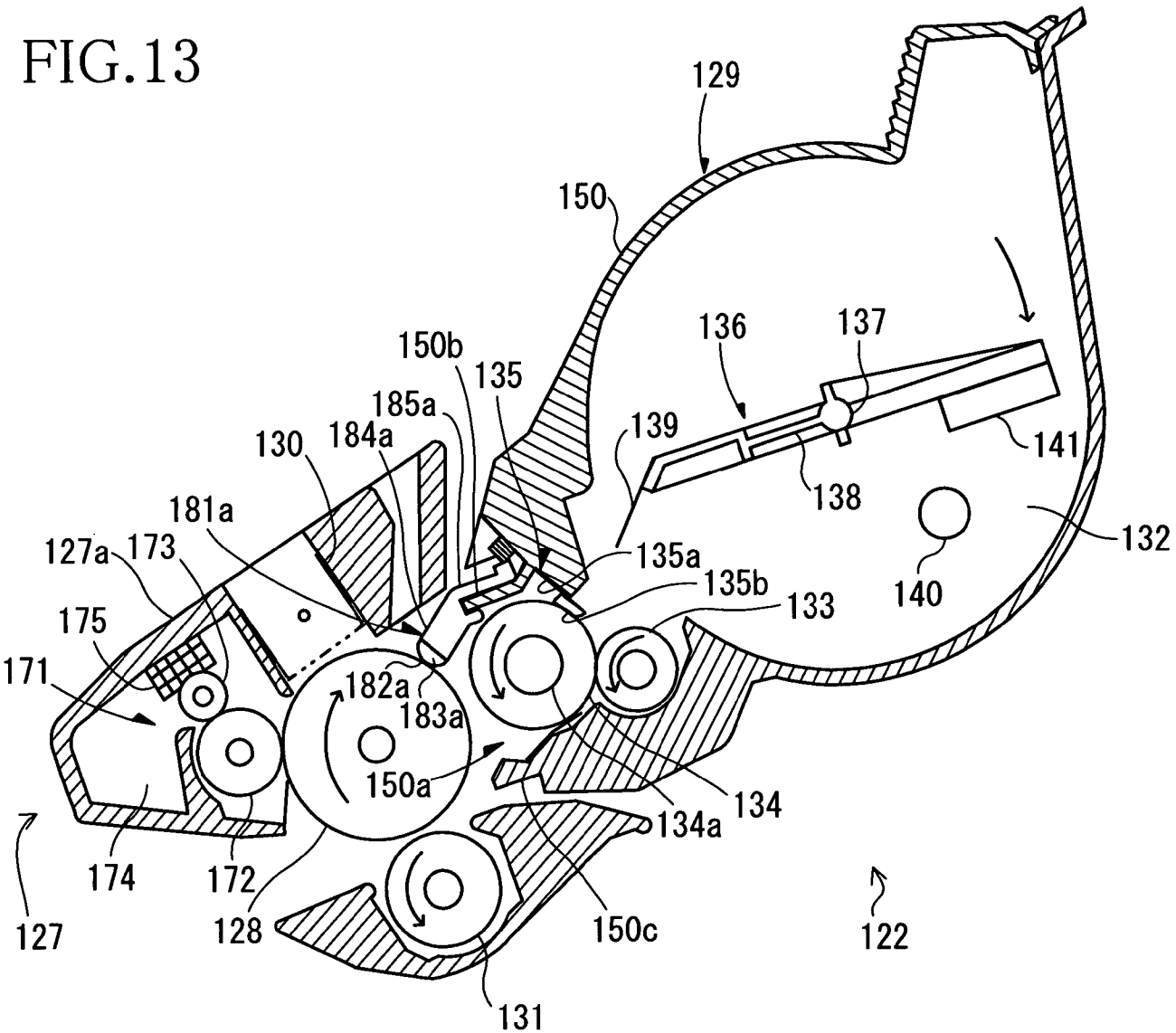
FIG. 13 is a sectional side view showing the processing unit of FIG. 8 having a contaminant removing member of another embodiment, wherein the contaminant removing member is fixed to an upper end portion only.

In FIG. 13, the same parts are designated by the similar numerals as the second embodiment, and explanations of those parts will be omitted. As shown in FIG. 13, a contaminant removing member 181*a* includes a contaminant removing portion 182*a*, a sponge member 183*a*, a support portion 184*a*, and an attaching portion 185*a*.

The attaching portion 185*a* has a plate shape and is made of hard resin. The attaching portion 185*a* extends along the longitudinal sides of the developing roller 134 so as to face the developing roller 134. The attaching portion 185*a* has a substantially C-shape so as to engage the upper end portion 150*b* of the housing 150.

The support portion 184*a* has a substantially rectangular plate shape and is made of hard resin. The support portion 184*a* is integrally formed with the attaching portion 185*a* along the longitudinal direction of the attaching portion 185*a*. The support portion 184*a* is bent to form a substantially open V-shape in cross section so as to extend in a direction from the attaching portion 185*a* engaged with the upper end portion 150*b* to the surface of the photosensitive drum 128.

The sponge member 183*a* is made of, for example, urethane sponge, and has a semicircular shape in cross section. The sponge member 183*a* is provided to a free end of the support portion 184*a* so as to extend along the longitudinal direction of the entire support portion 184*a*.

The contaminant removing portion 182*a* is made of a material, such as paper, wrapping paper, felt, or nonwoven fabric, and is adhered to the surface of the semicircular sponge member 183*a*. The materials suitable for the contaminant removing portion 182*a* are the same materials described previously.

In order to remove contaminants from the photosensitive drum 128, the contaminant removing member 181 a is attached to the developing cartridge 129 and then the developing cartridge 129 having the contaminant removing member 181*a* is attached to the drum cartridge 127, whereby the contaminant removing member 181*a* is positioned between the photosensitive drum 128 and the developing cartridge 129. In this state, the contaminant removing portion 182*a* contacts and presses the surface of the photosensitive drum 128 by the operation of the engaging and disengaging mechanism 201. By doing so, the contaminants adhering to the photosensitive drum 128 can be excellently removed.

Figure 14:
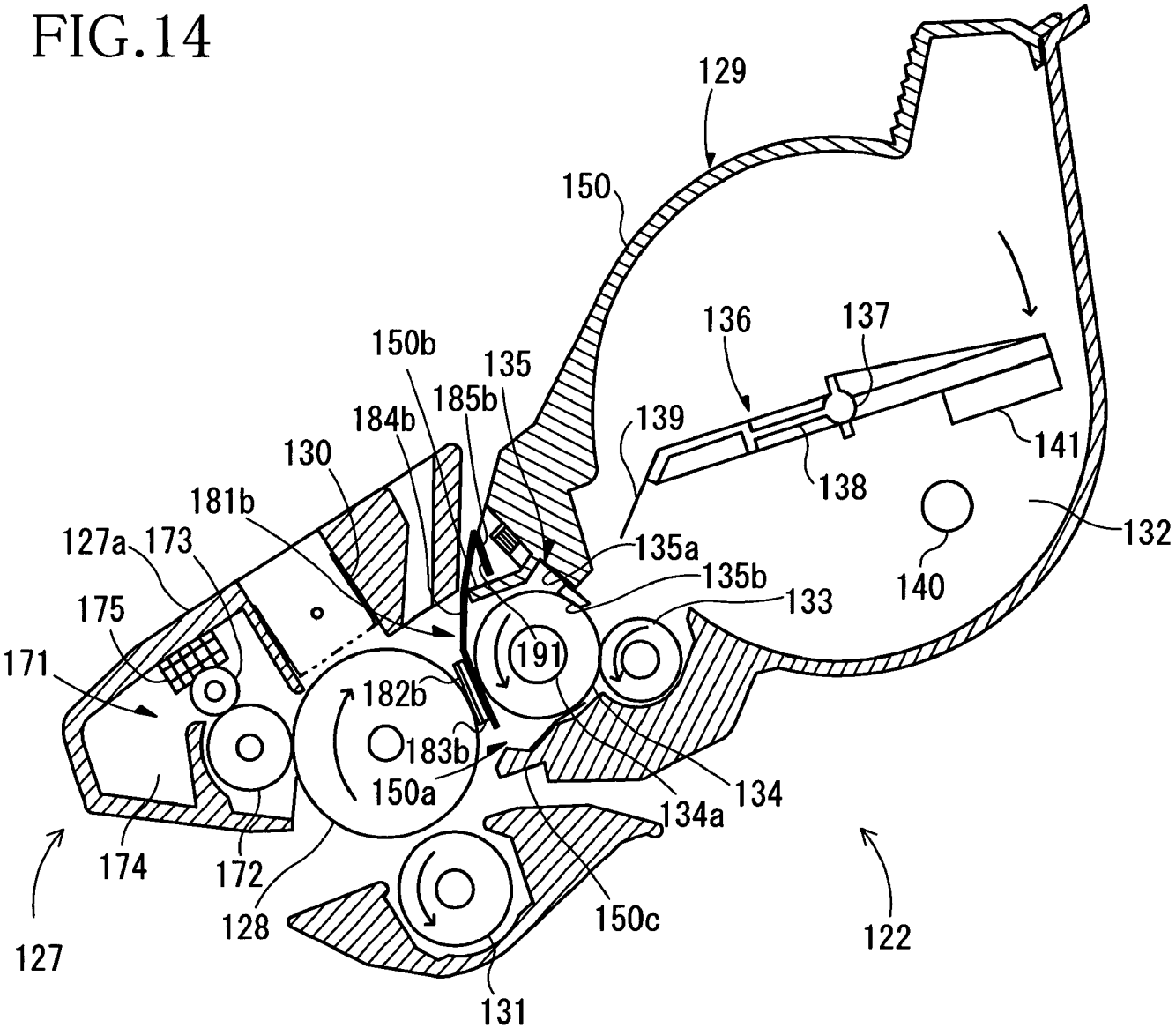
FIG. 14 is a sectional side view showing the processing unit of FIG. 8 having a contaminant removing member of another embodiment, wherein the contaminant removing member is made of a film and is fixed to a developing cartridge.

Alternatively, the support portion 184*b* and the attaching portion 185*b* of the contaminant removing member 181*b* can be made of a film as shown in FIG. 14. In FIG. 14, the same parts are designated by the similar numerals as the second embodiment, and explanations of those parts will be omitted.

As shown in FIG. 14, the contaminant removing member 181*b* includes a contaminant removing portion 182*b*, a sponge member 183*b*, the support portion 184*b*, and the attaching portion 185*b*. The support portion 184*b* and the attaching portion 185*b* are integrally formed by a flexible resin film made of polyethylene terephthalate (PET). The support portion 184*b* extends along the longitudinal sides of the developing roller 134 and faces the developing roller 134. An upper portion of the support portion 184*b* is bent into a substantially V-shape to form the attaching portion 185*b*. A lower part of the support portion 184*b* is bent so as to be opposite to the photosensitive drum 128 and is attached with the contaminant removing portion 182*b* via the sponge member 183*b*.

The sponge member 183*b* is made of urethane sponge and has a substantially rectangular shape. The sponge member 183*b* is adhered to the support portion 184*b* at a position opposite to the photosensitive drum 128, via an double-sided adhesive tape, while extending in the longitudinal direction of the support portion 184*b*. The contaminant removing portion 182*b* is made of a material, such as paper, wrapping paper, felt, or nonwoven fabric, and is adhered to the surface of the sponge member 183*b*. The materials suitable for the contaminant removing potion 182*b* are the same materials described previously.

The sponge member 183*b* and the contaminant removing portion 182*b* have a length, which is shorter than or equal to the longitudinal direction of the developing roller 134 and longer than or equal to the length of the image forming area of the photosensitive drum 128 in the axial direction of the photosensitive drum 128.

As shown in FIG. 14, an insertion groove 191, into which the attaching portion 185*b* is inserted, is provided above the upper end portion 150*b* of the housing 150 of the developing cartridge 129 to be attached with the contaminant removing member 181*b*. The contaminant removing member 181*b* can be detachably attached to the developing cartridge 129 by inserting the attaching portion 185*b* of the contaminant removing member 181*b* into the insertion groove 191 provided above the upper end portion 150*b* of the housing 150.

In order to remove contaminants from the photosensitive drum 128, the contaminant removing member 181*b* is attached to the developing cartridge 129 and then the developing cartridge 129 having the contaminant removing member 181*b* is attached to the drum cartridge 127. The contaminant removing member 181*b* is positioned between the photosensitive drum 128 and the developing cartridge 129 while the contaminant removing portion 182*b* faces the photosensitive drum 128. In this state, the contaminant removing portion 182*b* contacts and presses the surface of the photosensitive drum 128 by the operation of the engaging and disengaging mechanism 201. By doing so, contaminants adhering to the photosensitive drum 128 can be excellently removed.

The support portion 184*b* of the contaminant removing member 181 is made of a flexible resin film. As the contaminant removing member 181*b* is pressed by the engaging and disengaging mechanism 201, the developing roller 134 contacts the support portion 184*b*, so that the contaminant removing portion 182*b* is pressed against the photosensitive drum 128 by the pressure from the support portion 184*b*. With this structure, the pressing force from the contaminant removing member 181*b* against the surface of the photosensitive drum 128 can be surely ensured.

More particularly, the length of the contaminant removing portion 182*b* is shorter than or equal to the longitudinal direction of the developing roller 134, so that the entire contaminant removing portion 182*b* contacts the developing roller 134. Therefore, the entire contaminant removing portion 182*b* is uniformly pressed against the photosensitive drum 128. In addition, the length of the contaminant removing portion 182*b* is longer than or equal to the length of the image forming area in the longitudinal direction of the photosensitive drum 128, so that the contaminants adhering to the image forming area of the photosensitive drum 128 can be entirely surely removed.

Figure 15:
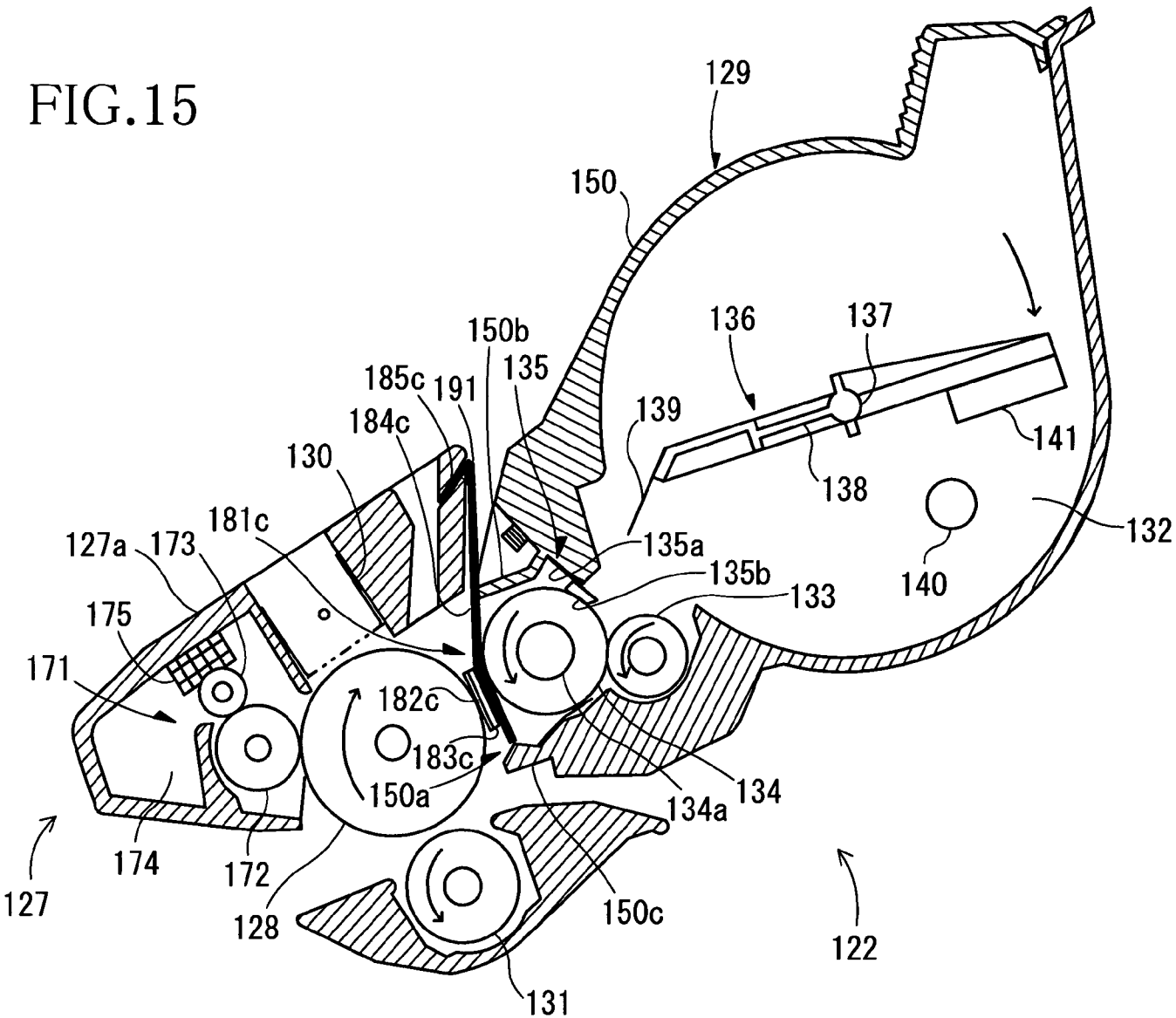
FIG. 15 is a sectional side view showing the processing unit of FIG. 8 having a contaminant removing member of another embodiment, wherein the contaminant removing member is made of a film and is fixed to a drum cartridge.

As shown in FIG. 15, an insertion groove 191 can be provided at an upper portion of the drum cartridge 127. A contaminant removing member 181*c* can be designed so as to be detachably attached to the drum cartridge 127 by inserting an attaching portion 185*c* of the contaminant removing member 181*c* into the insertion groove 191.

In FIG. 15, the same parts are designated by the similar numerals as the second embodiment, and explanations of those parts will be omitted. As shown in FIG. 15, the contaminant removing member 181*c* includes a contaminant removing portion 182*c*, a sponge member 183*c*, a support portion 184*c*, and the attaching portion 185*c*. Similar to the contaminant removing member 181*b* of FIG. 14, the support portion 184*c* and the attaching portion 185*c* are integrally formed by a flexible resin film made of polyethylene terephthalate (PET). The support portion 184*c* extends along the longitudinal direction of the developing roller 134 and faces the developing roller 134. An upper portion of the support portion 184*c* is bent into a substantially V-shape to form the attaching portion 185*c*. The bending direction of the attaching portion 185*c* is reversed to that of the attaching portion 185*b* of FIG. 14, when viewed from the side. A lower part of the support portion 184*c* is bent so as to be opposite to the photosensitive drum 128.

The sponge member 183*c* is made of urethane sponge and has a substantially rectangular shape. The sponge member 183*c* is adhered to the support portion 184*c* at a position opposite to the photosensitive drum 128 so as to extend in the longitudinal direction of the support portion 184*c*. The contaminant removing portion 182*c* is made of a material such as paper, wrapping paper, felt, or nonwoven fabric, and is adhered to the surface of the sponge member 183*b*. The materials suitable for the contaminant removing potion 182*c* are the same materials described previously.

The sponge member 183*c* and the contaminant removing portion 182*c* have a length, which is shorter than or equal to the longitudinal direction of the developing roller 134 and longer than or equal to the length of the image forming area of the photosensitive drum 128 in the axial direction of the photosensitive drum 128.

As shown in FIG. 15, the insertion groove 191 is provided in the portion of the housing 127*a* of the drum cartridge 127, wherein the portion is opposite to the opening 151*a* of the housing 150 of the developing cartridge 129.

In order to remove contaminants from the photosensitive drum 128, the contaminant removing member 181*c* is attached to the drum cartridge 127, by inserting the attaching portion 185*c* into the insertion groove 191, and then the developing cartridge 129 is attached to the drum cartridge 127. Thus, the contaminant removing member 181*c* is positioned between the photosensitive drum 128 and the developing cartridge 129 while the contaminant removing portion 182*c* faces the photosensitive drum 128. In this state, the contaminant removing portion 182*c* contacts the surface of the photosensitive drum 218 by the operation of the engaging and disengaging mechanism 201. By doing so, contaminants adhering to the photosensitive drum 128 can be excellently removed.

The support portion 184*c* of the contaminant removing member 181*c* is made of a flexible resin film. The contaminant removing member 181*c* is pressed by the engaging and disengaging mechanism 201 moving the developing cartridge 129 causing the developing roller 134 to contact the support portion 184*c* and press the contaminant removing portion 182*c* against the photosensitive drum 128 by the pressure from the support portion 184*c*. With this structure, the pressing force from the contaminant removing member 181*c* against the surface of the photosensitive drum 128 can be surely ensured.

More particularly, the length of the contaminant removing portion 182*c* is shorter than or equal to the longitudinal direction of the developing roller 134, so that the entire contaminant removing portion 182*c* contacts the developing roller 134. Therefore, the entire contaminant removing portion 182*c* is uniformly pressed against the photosensitive drum 128. In addition, the length of the contaminant removing portion 182*c* is longer than or equal to the length of the image forming area in the longitudinal direction of the photosensitive drum 128, so that the contaminants adhering to the image forming area of the photosensitive drum 128 can be entirely surely removed.

Figure 16:
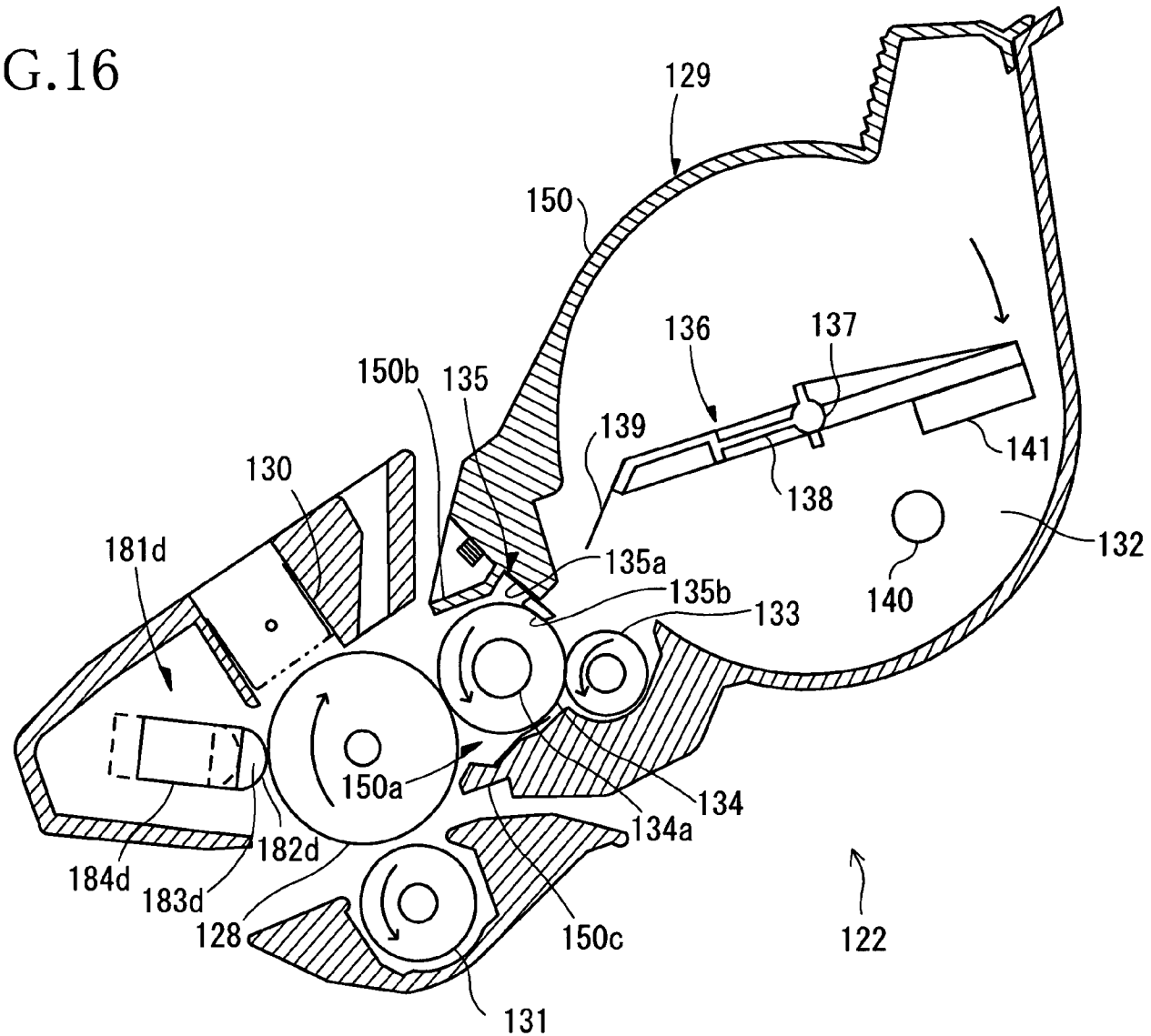
FIG. 16 is a sectional side view showing the processing unit of FIG. 8 having a contaminant removing member of another embodiment, wherein the contaminant removing member is provided so as to face the developing roller while sandwiching the photosensitive drum therebetween to freely advance and retract with respect to the photosensitive drum.

As shown in FIG. 16, a contaminant removing member 181*d* may be provided downstream of the transfer roller 131 and upstream of the Scorotron charging device 130 in the rotational direction of the photosensitive drum 128 so as to face the developing roller 134 while sandwiching the photosensitive drum 128 therebetween and for contact with and release from the photosensitive drum 128. In FIG. 16, the same parts are designated by the similar numerals as the second embodiment, and explanations of those parts will be omitted. The contaminant removing member 181*d* is provided instead of the cleaning portion 171 of the second embodiment.

As shown in FIG. 16, the contaminant removing member 181*d* includes a contaminant removing portion 182*d*, a sponge member 183*d*, and a support portion 184*d*.

The thick-plate like support portion 184*d* is made of hard resin. The support portion 184*d* has a substantially rectangular shape extending in the axial direction of the photosensitive drum 128. The contaminant removing member 181*d* is disposed so as to be opposite to the developing roller 134 with the photosensitive drum 128 sandwiched therebetween. The support portion 184*d* can move toward and retract from the photosensitive drum 128 so as to move between an engaged position where the contaminant removing portion 182*d* is in contact with the photosensitive drum 128 and a disengaged position where the contaminant removing portion 182*d* is a distance from the photosensitive drum 128. The sponge member 183*d* is made of urethane sponge and has a semicircular shape in cross section. The sponge member 183*d* is adhered to the entire support portion 184*d* in the width direction, at the side to be contacted with the photosensitive drum 128. The contaminant removing portion 182*d* is made of a material, such as paper, wrapping paper, felt, or nonwoven fabric, and is adhered to the surface of the sponge member 183*d*. The materials suitable for the contaminant removing portion 182*d* are the same materials described previously.

When a solenoid (not shown) presses the support portion 184*d*, the support portion 184*d* moves to the engaged position to contact the contaminant removing portion 182*d* to the photosensitive drum 128. The contaminant removing portion 182*d* contacts the surface of the photosensitive drum 128 with a relatively strong pressure, so that contaminants adhering to the photosensitive drum 128 are excellently removed.

When the contaminant removing operation is completed, the support portion 184*d* is moved to the disengaged position by the solenoid, so that the contaminant removing portion 182*d* is positioned at a distance from the photosensitive drum 128. Accordingly, damage to the photosensitive drum 128 can be reduced to a minimum.

Figure 17:
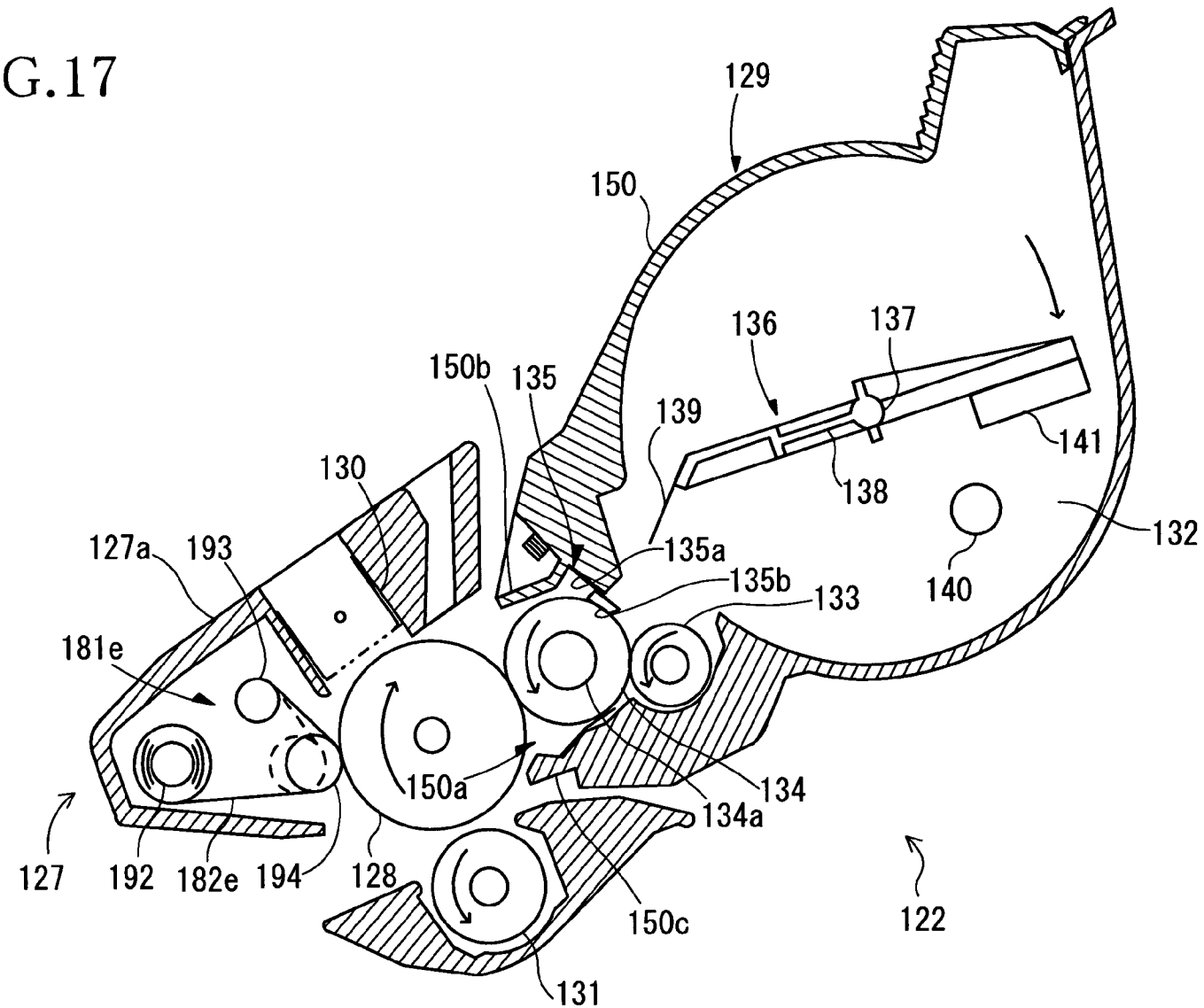
FIG. 17 is a sectional side view showing the processing unit of FIG. 8 having a contaminant removing member of another embodiment, wherein the contaminant removing member is provided so as to face the developing roller while sandwiching the photosensitive drum therebetween and can be taken up by a take-up roller.

As shown in FIG. 17, a contaminant removing portion 182*e* may be a windable film. In FIG. 17, the same parts are designated by the similar numerals as the second embodiment, and explanations of those parts will be omitted. The contaminant removing member 181*e* is provided instead of the cleaning portion 171 of the second embodiment.

As shown in FIG. 17, the contaminant removing member 181*e* is disposed so as to be opposite to the developing roller 134 with the photosensitive drum 128 sandwiched therebetween. The contaminant removing member 181*e* includes a contaminant removing portion 182*e*, a supply roller 192, a take-up roller 193, and a contacting roller 194.

The supply roller 192 is rotatably disposed in the drum cartridge 127. The contaminant removing portion 182*e* is made of a flexible strip of paper or resin film wound around the supply roller 192 and drawn from the supply roller 192.

The take-up roller 193 is rotatably provided in the drum cartridge 127 at a predetermined distance away from the supply roller 192. The take-up roller 193 takes up the contaminant removing portion 182*e* drawn from the supply roller 192.

The contacting roller 194 is disposed at a predetermined distance away from the supply roller 192 and the take-up roller 193 so that the supply roller 192, the take-up roller 193 and the contacting roller 194 substantially form a triangle. The contacting roller 194 is provided downstream of the transfer roller 131 and upstream of the Scorotron charging device 130 in the rotational direction of the photosensitive drum 128 so as to be opposite to the developing roller 134 with the photosensitive drum 128 sandwiched therebetween.

The contacting roller 194 can move toward and retract from the photosensitive drum 128 so as to move between an engaged position where the contaminant removing portion 182*e* is in contact with the photosensitive drum 128 and a disengaged position where the contaminant removing portion 182*e* is positioned at a distance from the photosensitive drum 128. The contaminant removing portion 182*e* is drawn from the supply roller 192 and taken up by the take-up roller 193 via the contacting roller 194 while being conveyed between the contacting roller 194 and the photosensitive drum 128.

When a solenoid (not shown) presses the contacting roller 194, the contacting roller 194 moves to the engaged position to contact the contaminant removing potion 182*e* to the photosensitive drum 128. The contaminant removing portion 182*e* contacts the surface of the photosensitive drum 128 with a relatively strong force, so that contaminants adhering to the photosensitive drum 128 are excellently removed.

When the contaminant removing operation is completed, the contacting roller 194 is moved to the disengaged position by the solenoid, so that the contaminant removing portion 182*e* is positioned at a distance from the photosensitive drum 128. Accordingly, damage to the photosensitive drum 128 can be minimized.

After removing contaminants from the photosensitive drum 128, the surface of the contaminant removing portion 182*e*, which was in contact with the photosensitive drum 128 becomes dirty. Thus, the contaminant removing portion 182*e* is taken up by the take-up roller 193, as necessary, to refresh the surface of the contaminant removing portion 182*e* that contacts the photosensitive drum 128. By doing so, the contaminants adhering to the photosensitive drum 128 can be excellently removed.

Figure 18:
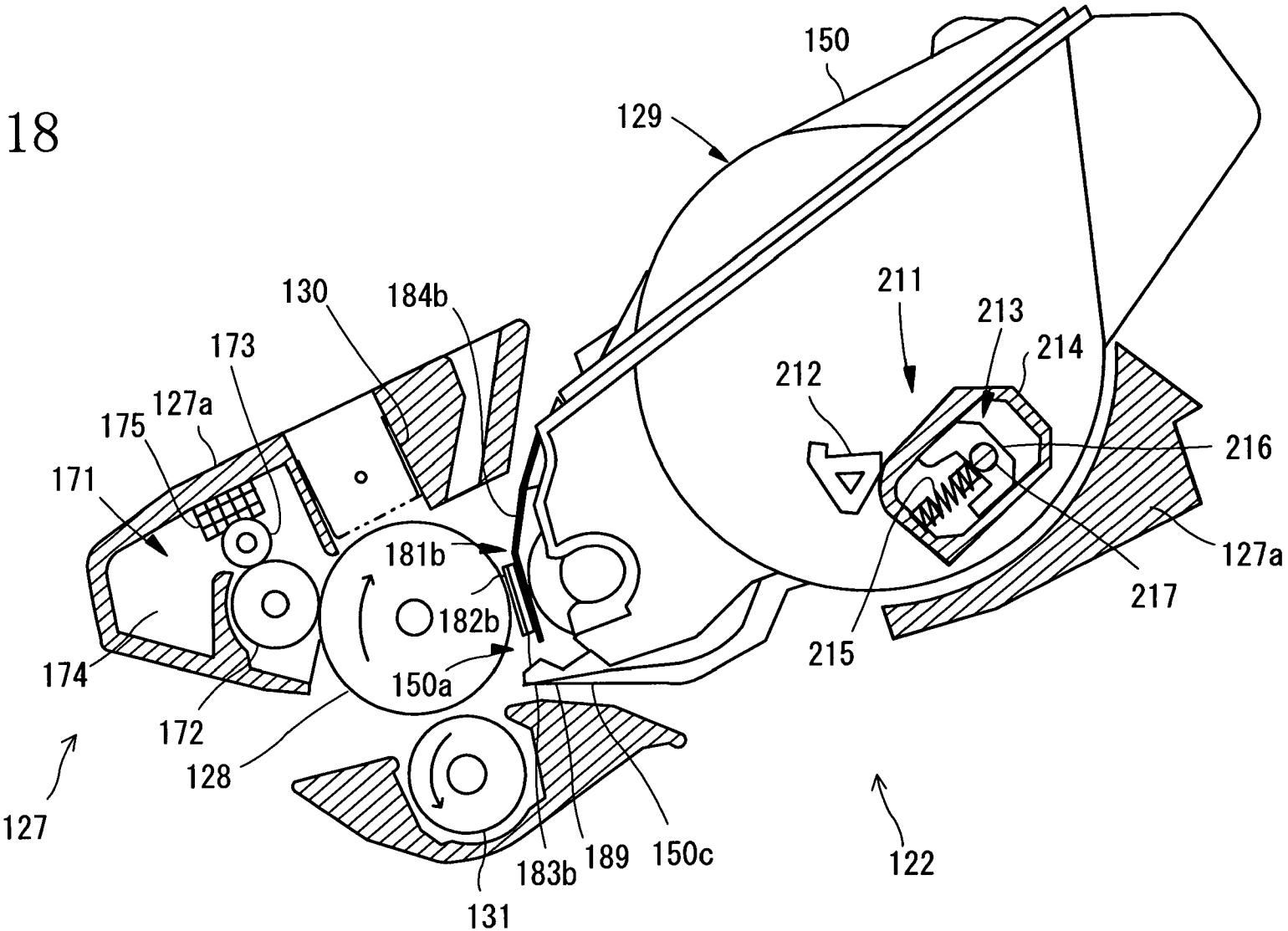
FIG. 18 is a sectional side view showing essential parts of an urging mechanism of the processing unit of FIG. 8.

In the processing unit 122 wherein the developing roller 134 is pressed toward the photosensitive drum 128 at all times, as shown in FIG. 18, an urging mechanism 211 for urging the developing cartridge 129 toward the drum cartridge 127 may be provided to make a contaminant removing member 181*b* contact with the photosensitive drum 128.

As shown in FIG. 18, in the housing 150 of the developing cartridge 129, the urging mechanism 211 includes a pressing portion 212, which protrudes and extends in the axial direction of the developing roller 134, a spring support member 213, which is provided to the housing 127*a* of the drum cartridge 127, a slide member 214, which is externally engaged with the spring support member 213, and a spring 215, which is provided in the spring support member 213.

The spring support member 213 includes a spring fixing portion 216, which fixes the spring 215, and a support shaft 217, which is rotatably supported in the housing 127*a* of the drum cartridge 127. The spring fixing portion 216 and the support shaft 217 are integral to form a monolithic structure. The spring support member 213 is provided in the housing 127*a* of the drum cartridge 127 so as to be rotatable about the support shaft 217. The slide member 214 has a frame shape and houses the spring fixing portion 216 therein. One end of the spring 215 is fixed by the spring fixing portion 216 and the other end is fixed to the inner surface of the slide member 214.

When the developing cartridge 129 is attached to the drum cartridge 127, the pressing portion 212 contacts and presses the slide member 214, that the slide member 214 moves toward the spring fixing portion 216 against the urging force from the spring 215.

The pressing portion 212 is pressed toward the photosensitive drum 128 by resilience of the spring 215. As a result of this, the contaminant removing portion 182*b* of the contaminant removing member 181*b*, which is attached to the housing 150 with covering the opening 150*a* of the housing 150, contacts the surface of the photosensitive drum 128.

In order to disengage the contaminant removing member 181*b* from the photosensitive drum 128, the developing cartridge 129 is detached from the drum cartridge 127. Then, the contaminant removing member 181*b* can be detached from the housing 150 of the developing cartridge 129. The spring support member 213 can be provided to the casing 102 instead of provided to the housing 127*a* of the drum cartridge 127.

Figure 19:
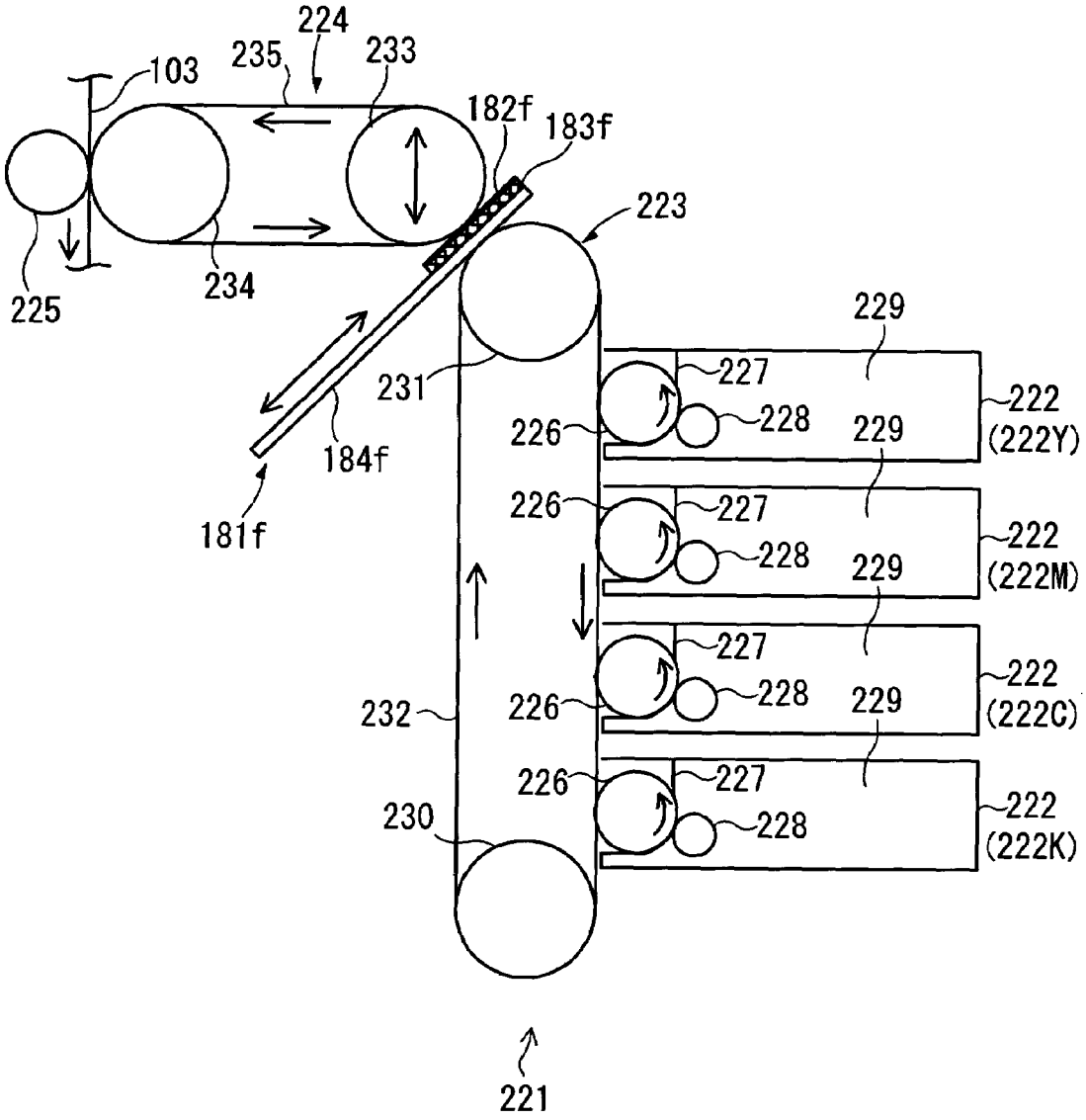
FIG. 19 is a schematic diagram showing essential parts of a four-cycle color laser-beam printer including a contaminant removing member.

Although, in the second embodiment and its variations, the contaminant removing member 181 is applied to the monochrome laser-beam printer 101 to remove the contaminants from the surface of the photosensitive drum 128, the contaminant removing member 181 can be also applied to a color laser-beam printer 221 to remove contaminants adhering to an intermediate transfer belt 235 as shown in FIG. 19. FIG. 19 shows essential parts of a four-cycle color laser-beam printer 221. The color laser-beam printer 221 forms a color image onto a sheet by sequentially forming toner images, by color, onto a photosensitive belt 232 using developing rollers 226 for each color and overlapping the toner images on one another on the intermediate transfer belt 235.

The color laser-beam printer 221 includes four developing cartridges 222, a photosensitive belt mechanism 223, an intermediate transfer belt mechanism 224, and a transfer roller 225. The four developing cartridges 222 include an yellow developing cartridge 222Y storing yellow toner, a magenta developing cartridge 222M storing magenta toner, a cyan developing cartridge 222C storing cyan toner, and a black developing cartridge 222K storing black toner. The developing cartridges 222Y, 222M, 222C, 222K are aligned in parallel with each other with a predetermined distance therebetween.

The developing cartridges 222Y, 222M, 222C, 222K each include a developing roller 226, a layer-thickness regulating blade 227, a toner supply roller 228, and a toner storage chamber 229. Each of the developing cartridges 222Y, 222M, 222C, 222K can be moved in the horizontal direction by an engaging and disengaging mechanism (not shown) so that the developing roller 226 is brought into contact with or is separated from the surface of the photosensitive belt 232.

The toner storage chambers 229 of the developing cartridges 222Y, 222M, 222C, 222K are filled with the respective toner of yellow, magenta, cyan, and black. The toner stored in the toner storage chambers 229 is also polymerized toner, which is the same as the toner used in the first and second embodiments. The toner supply roller 228 and the developing roller 226 are rotatably provided while contacting each other so as to apply some pressure to one another.

In each of the developing cartridges 222Y, 222M, 222C, 222K, the toner stored in the toner storage chamber 229 is supplied to the developing roller 226 by the rotation of the toner supply roller 228. The toner supplied onto the developing roller 226 is formed into a thin layer having a uniform thickness by the layer-thickness regulating blade 227 and is held by the surface of the developing roller 226.

The photosensitive belt mechanism 223 is disposed next to the developing cartridges 222. The photosensitive belt mechanism 223 includes a photosensitive body support roller 230 facing the black developing cartridge 222K, a photosensitive body drive roller 231 facing the yellow developing cartridge 222Y, and a photosensitive belt 232. The photosensitive belt 232 is an endless belt, which is wound around the photosensitive body support roller 230 and the photosensitive body drive roller 231. In the photosensitive belt mechanism 223, as the photosensitive body drive roller 231 is driven, and the photosensitive body support roller 230 follows the rotation of the photosensitive body drive roller 231, so that the photosensitive belt 232 travels around the photosensitive body support roller 230 and the photosensitive body drive roller 231 in a direction indicated by an arrow in FIG. 19.

The intermediate transfer belt mechanism 224 includes an intermediate transfer body drive roller 233 facing the photosensitive body drive roller 231, an intermediate transfer body support roller 234 facing to the transfer roller 225, and an intermediate transfer belt 235, which is an endless belt. The intermediate transfer body drive roller 233 is moved between a developing position where the photosensitive belt 232 and the intermediate transfer belt 235 are in contact with each other and a non-developing position where the photosensitive belt 232 is positioned at a distance from the intermediate transfer belt 235, by a solenoid (not shown). In the intermediate transfer belt mechanism 224, as the intermediate transfer body drive roller 233 is driven, the intermediate transfer body support roller 234 follows the rotation of the intermediate transfer body drive roller 233, so that the intermediate transfer belt 235 travels around the intermediate transfer body drive roller 233 and the intermediate transfer body support roller 234 in a direction indicated by an arrow of FIG. 19.

After the surface of the photosensitive belt 232 is uniformly positively charged by a Scorotron charging device (not shown), the surface of the photosensitive belt 232 is exposed to a laser beam emitted from a scanner unit (not shown). Thus, an electrostatic latent image is formed on the surface of the photosensitive belt 232 based on image data.

The developing roller 226 of a specific developing cartridge 222 contacts the photosensitive belt 232 having the electrostatic latent image thereon, thereby forming a single-color toner image on the photosensitive belt 232. The single-color toner image formed on the photosensitive belt 232 is then transferred onto the intermediate transfer belt 235. This operation is sequentially performed by color and a toner image in a single-color of each color is overlapped on one another on the intermediate transfer belt 235, thereby forming a full-color image on the intermediate transfer belt 235. The full-color image formed on the intermediate transfer belt 235 is then transferred onto a sheet 103 when the sheet 103 passes between the intermediate transfer belt 235 and the transfer roller 225.

A contaminant removing member 181*f* is provided so as to move toward and retract from between the photosensitive body drive roller 231 and the intermediate transfer body drive roller 233. The contaminant removing member 181*f* includes a contaminant removing portion 182*f*, a sponge member 183*f*, and a support portion 184*f*.

The support portion 184*f* is made of hard resin and has a substantially rectangular plate shape. The width of the support portion 184*f* is greater than the width of the intermediate transfer belt 235. As shown in FIG. 19, the support portion 184*f* is moved between an engaged position where the contaminant removing portion 182*f* contacts the intermediate transfer belt 235 and a disengaged position where the contaminant removing portion 182*f* is positioned at a distance from the intermediate transfer belt 235, by a solenoid (not shown).

The plate-like sponge member 183*f* is made of urethane sponge and is disposed at an end portion of the support portion 184*f* so as to face the intermediate transfer belt 235 and extend in the width direction of the support portion 184*f*. The contaminant removing portion 182*f* is made of a material, such as paper, wrapping paper, felt, or nonwoven fabric, and is adhered to the surface of the sponge member 183*f*. The materials suitable for the contaminant removing portion 182*f* are the same materials described previously.

In order to remove contaminants adhering to the surface of the intermediate transfer belt 235, as shown in FIG. 19, the support portion 184*f* is pressed by the solenoid in a state where the intermediate transfer body drive roller 233 is positioned at the non-developing portion to move the support portion 184*f* to the engaged position, so that the contaminant removing portion 182*f* contacts and presses the surface of the intermediate transfer belt 235 with a relatively strong pressure. Accordingly, the contaminants adhering to the intermediate transfer belt 235 can be excellently removed.

When the contaminant removing operation is completed, the support portion 184*f* is retracted by the solenoid, so that the contaminant removing portion 182*f* is separated from the intermediate transfer belt 235 and kept in the separated state. By doing so, damage to the surface of the intermediate transfer belt 235 can be minimized. After the contaminant removing operation, the intermediate transfer body drive roller 233 is moved to the developing position.

The contaminant removing member 181*f* is positioned between the photosensitive body drive roller 231 and the intermediate transfer body drive roller 233 while the contaminants are removed from the intermediate transfer belt 235. Accordingly, the pressing force exerted toward the intermediate transfer belt 235 from the photosensitive belt 232 is applied to the contaminant removing member 181*f*, so that the contaminants adhering to the intermediate transfer belt 235 can be surely removed.

Figure 20:
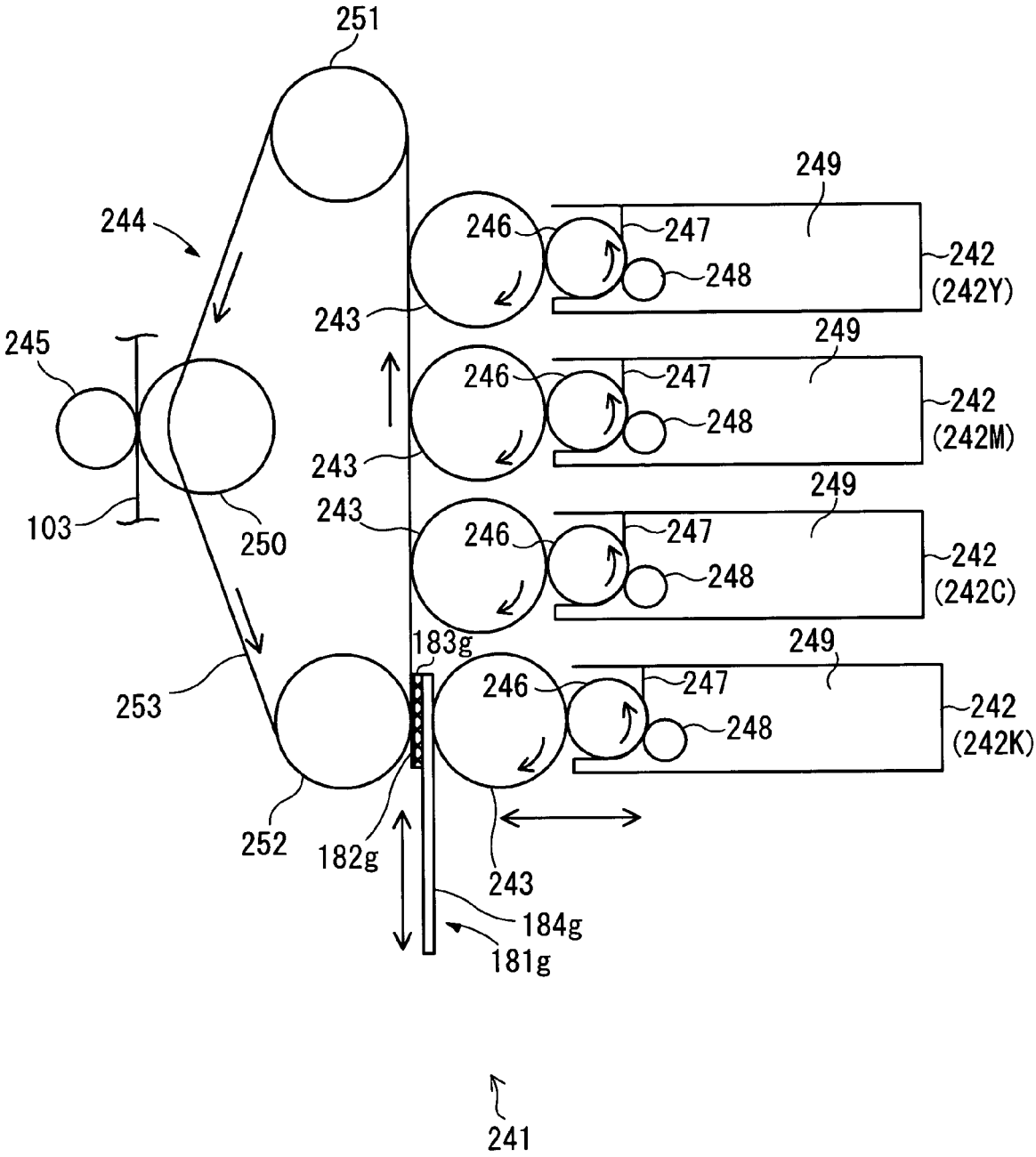
FIG. 20 is a schematic diagram showing essential parts of a tandem type color laser-beam printer including a contaminant removing member.

As shown in FIG. 20, the invention can be also applied to a tandem type color-laser printer 241, including a photosensitive drum 243 for each color, to remove contaminants adhering to an inter-mediate transfer belt 253. The color laser-beam printer 241 includes four developing cartridges 242, four photosensitive drums 243, an intermediate transfer belt mechanism 244, and a transfer roller 245.

The four developing cartridges 242 include an yellow developing cartridge 242Y storing yellow toner, a magenta developing cartridge 242M storing magenta toner, a cyan developing cartridge 242C storing cyan toner, and a black developing cartridge 242K storing black toner. The developing cartridges 242Y, 242M, 242C, 242K are aligned in parallel with each other at a predetermined distance therebetween.

The developing cartridges 242Y, 242M, 242C, 242K each includes a developing roller 246, a layer-thickness regulating blade 247, a toner supply roller 248, and a toner storage chamber 249. In each of the developing cartridges 242Y, 242M, 242C, 224K, the toner stored in the toner storage chamber 249 is supplied to the developing roller 246 by the rotation of the toner supply roller 248. The toner supplied onto the developing roller 246 is formed into a thin layer having a uniform thickness by the layer-thickness regulating blade 247 and is held by the surface of the developing roller 246.

The photosensitive drums 243 are provided so as to face the respective developing cartridges 242. After the surfaces of the photosensitive drums 243 are uniformly positively charged by a Scorotron charging device (not shown), the surfaces of the photosensitive drums 243 are exposed to a laser beam emitted from a scanner unit (not shown). Thus, an electrostatic latent image is formed on each photosensitive drum 243 based on image data. The electrostatic latent images are developed by the respective colors of toner held by the respective developing rollers 246 and, thus, toner images are formed on the photosensitive drums 243.

The black developing cartridge 242K and the photosensitive drum 243 for the black developing cartridge 242 can move in the horizontal direction between a developing position where a second intermediate transfer body support roller 252 contacts the photosensitive drum 243 and a non-developing position where the second intermediate transfer body support roller 252 is positioned at a distance from the photosensitive drum 243, by an engaging and disengaging mechanism (not shown), as shown by an arrow in FIG. 20.

The intermediate transfer belt mechanism 244 is disposed next to the photosensitive drums 243 and includes an intermediate transfer body drive roller 250, which faces a transfer roller 245, a first intermediate transfer body support roller 251, which faces the yellow developing cartridge 242Y, the second intermediate transfer body support roller 252, which faces the black developing cartridge 242K, and the intermediate transfer belt 253. The intermediate transfer belt 253 is an endless belt, which is wound around the first intermediate transfer body support roller 251, the second intermediate transfer body support roller 252, and the intermediate transfer body drive roller 250.

In the intermediate transfer belt mechanism 244, as the intermediate transfer body drive roller 250 is driven, the first intermediate transfer body support roller 251 and the second intermediate transfer body support roller 252 follow by the rotation of the intermediate transfer body drive roller 250, so that the intermediate transfer belt 253 travels around the intermediate transfer body drive roller 250, the first intermediate transfer body support roller 251 and the second intermediate transfer body support roller 252 in a direction indicated by an arrow in FIG. 20.

In the color laser-beam printer 241, first, an yellow toner image, formed on the photosensitive drum 243 of the yellow developing cartridge 242Y, is transferred onto the intermediate transfer belt 253, and then a magenta toner image, formed on the photosensitive drum 243 of the magenta developing cartridge 242M, is transferred onto the intermediate transfer belt 253 so that the magenta toner image overlaps the yellow toner image. Similarly, a cyan toner image, formed on the photosensitive drum 243 of the cyan developing cartridge 242C, and a black toner image, formed on the photosensitive drum 243 of the black developing cartridge 242K, are transferred onto the intermediate transfer belt 253 so as to overlap one another. By doing so, a color image is formed on the intermediate transfer belt 253. The color image formed on the intermediate transfer belt 253 is then transferred onto a sheet 103 when the sheet 103 passes between the intermediate transfer belt 253 and the transfer roller 245.

A contaminant removing member 181*g* is disposed so as to move to and retract from between the second intermediate transfer body support roller 252 and the photosensitive drum 243 for the black developing cartridge 144K. The contaminant removing member 181*g* includes a contaminant removing portion 182*g*, a sponge member 183*g*, and a support portion 184*g*.

The support portion 184*g* is made of hard resin and has a substantially rectangular plate shape. The width of the support portion 184*g* is greater than the width of the intermediate transfer belt 253. As shown in FIG. 20, the support portion 184*g* moves between an engaged position where the contaminant removing portion 182*g* contacts the intermediate transfer belt 235 and a disengaged position where the contaminant removing portion 182*g* is positioned at a distance from the intermediate transfer belt 253.

The plate-like sponge member 183*g* is made of urethane sponge and is disposed at an end portion of the support portion 184*g* so as to face the intermediate transfer belt 235 and extend in the width direction of the support portion 184*g*. The contaminant removing portion 182*g* is made of a material, such as paper, wrapping paper, felt, or nonwoven fabric, and is adhered to the surface of the sponge member 183*g*. The materials suitable for the contaminant removing portion 182*g* are the same materials described previously.

In order to remove contaminants adhering to the surface of the intermediate transfer belt 253, the support portion 184*g* is pressed by a solenoid (not shown) in a state where the photosensitive drum 243 for the black developing cartridge 242K is positioned at the non-developing portion to move the support portion 184*g* to the engaged position, so that the contaminant removing portion 182*g* contacts and presses the surface of the intermediate transfer belt 253 with a relatively strong pressure. Accordingly, the contaminants adhering to the intermediate transfer belt 253 can be excellently removed.

When the contaminant removing operation is completed, the support portion 184*g* is moved to the disengaged position by the solenoid, so that the contaminant removing portion 182*g* is separated from the intermediate transfer belt 253 and kept in this state. By doing so, damage to the surface of the intermediate transfer belt 235 can be minimized. After the contaminant removing operation, the black developing cartridge 242K and the photosensitive drum 243 for the black developing cartridge 242K are moved to the developing position.

The sponge members 183, 183*a*, 183*b*, 183*c*, 183*d*, 183*f*, 183*g* may be an elastic member, such as rubber.

While the invention has been described in detail with reference to the specific embodiments thereof, it would be apparent to those skilled in the art that various changes, arrangements and modifications may be applied therein without departing from the spirit and scope of the invention.

What is claimed is:

1. An image forming apparatus, comprising:

a photosensitive body;

a cleaning member that removes contaminants adhering to a surface of the photosensitive body by contacting and pressing the surface of the photosensitive body;

a moving device that moves the cleaning member between a position where the cleaning member contacts the surface of the photosensitive body and a position where the cleaning member is positioned at a distance from the surface of the photosensitive body; and a controller that controls the moving device at a predetermined timing for contacting the cleaning member to the surface of the photosensitive body, wherein the cleaning member includes a contacting member that contacts the photosensitive body and a support member that supports the contacting member, the support member includes an elastic body and the contacting member is made of a fiber material, and the contacting member includes paper which is made from only virgin pulp with 15% or less by weight of a filler mixed therein.

2. The image forming apparatus according to claim 1, wherein the predetermined timing is a time at which an image forming operation is not performed, and the controller controls the moving device so that the cleaning member contacts the surface of the photosensitive body at the timing.

3. The image forming apparatus according to claim 2, wherein the predetermined timing is at least one of the time at which the toner empty indication is provided, the indication of toner empty is removed, the time at which a predetermined number of sheets has been printed, the time while the image forming apparatus is warmed up, and the time at which the image forming apparatus is turned on.

4. The image forming apparatus according to claim 1, further comprising:

a developing agent holding member that holds a developing agent to be supplied to the photosensitive body; and a transfer device that transfers the developing agent supplied to the photosensitive body onto a recording medium, wherein the controller controls the moving device so that the cleaning member contacts the surface of the photosensitive body after a position, at which the transfer of the developing agent on the photosensitive body to the recording medium is completed, reaches the developing agent holding member.

5. A processing unit, comprising:

a photosensitive body;

a cleaning member that removes contaminants adhering to a surface of the photosensitive body by contacting and pressing the surface of the photosensitive body; and a moving device that moves the cleaning member between a position where the cleaning member contacts the surface of the photosensitive body and a position where the cleaning member is positioned at a distance from the surface of the photosensitive body, wherein the cleaning member includes a contacting member that contacts the photosensitive body and a support member that supports the contacting member, the support member includes an elastic body and the contacting member is made of a fiber material, and the contacting member includes paper which is made from only virgin pulp with 15% or less by weight of a filler mixed therein.

6. The processing unit according to claim 5, wherein the moving member includes a pressing member that presses the cleaning member toward the photosensitive body.

7. The processing unit according to claim 6, further comprising a developing agent holding member that is disposed so as to face the photosensitive body and holds a developing agent to be supplied to the photosensitive body, wherein the cleaning member is disposed between the photosensitive body and the developing agent holding member.

8. The processing unit according to claim 7, further comprising a holding member support member that supports the developing agent holding member, wherein the cleaning member is attached to and detached from the holding member support member, and the pressing member presses the holding member support member toward the photosensitive body.

9. The processing unit according to claim 7, further comprising a photosensitive body support member that supports the photosensitive body, wherein the cleaning member is attached to and detached from the photosensitive body support member, and the pressing member presses the holding member support member toward the photosensitive body.

10. A processing device, comprising:

a photosensitive body;

a developing agent holding member that is provided so as to face the photosensitive body and holds a developing agent to be supplied to the photosensitive body; and a contaminant removing member that is provided between the photosensitive body and the developing agent holding member and removes contaminants adhering to the photosensitive body by contacting a surface of the photosensitive body.

11. The processing device according to claim 10, wherein the contaminant removing member includes:

a contacting member that removes contaminants adhering to a surface of the photosensitive body by contacting and pressing the surface of the photosensitive body, and a support member that supports the contacting member; and the processing device further comprises:

a moving device that moves the contaminant removing member between a position where the contaminant removing member contacts the surface of the photosensitive body and a position where the contaminant removing member is positioned at a distance from the surface of the photosensitive body.

12. The processing device according to claim 11, wherein the moving device includes a pressing member that presses the contaminant removing member toward the photosensitive body.

13. The processing device according to claim 12, further comprising:

a developing agent holding member that is disposed so as to face the photosensitive body and holds a developing agent to be supplied to the photosensitive body; and a holding member support member that supports the developing agent holding member, wherein the contaminant removing member is attached to and detached from the holding member support member, and the pressing member presses the holding member support member toward the photosensitive body.

14. The processing device according to claim 12, further comprising a photosensitive body support member that supports the photosensitive body, wherein the contaminant removing member is attached to and detached from the photosensitive body support member, and the pressing member presses the holding member support member toward the photosensitive body.

15. The processing device according to claim 11, wherein the support member includes an elastic body and the contacting member is made of a fiber material.

16. The processing device according to claim 15, wherein the contacting member includes paper made from the fiber material.

17. The processing device according to claim 16, wherein the contacting member includes paper made from a cellulosic fiber.

18. The processing device according to claim 17, wherein the contacting member includes paper which is made from only virgin pulp with 15% or less by weight of a filler mixed therein.

19. The processing device according to claim 11, further comprising a controller that controls the moving device at a predetermined timing for contacting the contaminant removing member to the surface of the photosensitive body, wherein the predetermined timing is a time at which an image forming operation is not performed, and the controller controls the moving device so that the contaminant removing member contacts the surface of the photosensitive body at the timing.

20. The processing device according to claim 19, wherein the predetermined timing is at least one of a time at which the toner empty indication is provided, an indication of toner empty is removed, a time at which a predetermined number of sheets has been printed, the time while the processing device is warmed up, and a time at which the processing device is turned on.

21. The processing device according to claim 11, further comprising:

a controller;

a developing agent holding member that holds a developing agent to be supplied to the photosensitive body; and a transfer device that transfers the developing agent supplied to the photosensitive body onto a recording medium, wherein the controller controls the moving device so that the contaminant removing member contacts the surface of the photosensitive body after a position, at which the transfer of the developing agent on the photosensitive body to the recording medium is completed, reaches the developing agent holding member.

22. A developing unit, comprising:

a container that houses a developing agent;

a developing agent holding member that holds the developing agent;

a holding member support member that supports the developing agent holding member; and a contaminant removing member that is detachably attached to the holding member support member, wherein the container and the holding member support member are a unitary structure to which the contaminant removing member is detachably attached.

23. A processing device, comprising:

a photosensitive body;

a photosensitive body support member that supports the photosensitive body; and a developing unit that is attached to and detached from the photosensitive body support member; the developing unit comprising:

a container that houses a developing agent;

a developing agent holding member that holds the developing agent;

a holding member support member that supports the developing agent holding member; and a contaminant removing member that is detachably attached to the holding member support member.

24. The processing device according to claim 23, wherein the contaminant removing member is positioned between the photosensitive body and the developing agent holding member in a state where the developing unit is attached to the photosensitive body support member.

25. A contaminant removing member, comprising:

a contaminant removing portion that is made of the fiber material; and a support member that supports the contaminant removing portion, wherein the contaminant removing portion includes paper which is made from only virgin pulp with 15% or less by weight of a filler mixed therein.

26. The contaminant removing member according to claim 25, further comprising an elastic body interposed between the contaminant removing portion and the support portion.

27. An image forming apparatus, comprising:

a developing agent holding member that holds an developing agent;

a photosensitive body that is disposed to face the developing agent holding member and holds a developing agent image;

an intermediate transfer body onto which the developing agent image held by the photosensitive body is transferred;

a contaminant removing member that is provided between the photosensitive body and the intermediate transfer body so as to be movable between a position where the contaminant removing member contacts a surface of the intermediate transfer body and a position where the contaminant removing member is positioned at a distance from the surface of the intermediate transfer body.

* * * * *